US011457732B2

(12) United States Patent
Colin et al.

(10) Patent No.: US 11,457,732 B2
(45) Date of Patent: Oct. 4, 2022

(54) CHASE FOR CONNECTING TABLES

(71) Applicant: HERMAN MILLER, INC., Zeeland, MI (US)

(72) Inventors: Kimberlee Colin, London (GB); Luca Corvatta, London (GB); Samuel Hecht, London (GB); Gary Craig Smith, Holland, MI (US); Romain Voulet, London (GB); Tyler Gregory Finses, Holland, MI (US)

(73) Assignee: MillerKnoll, Inc., Zeeland, MI (US)

( * ) Notice: Subject to any disclaimer, the term of this patent is extended or adjusted under 35 U.S.C. 154(b) by 0 days.

(21) Appl. No.: 17/145,992

(22) Filed: Jan. 11, 2021

(65) Prior Publication Data

US 2021/0212452 A1 Jul. 15, 2021

Related U.S. Application Data

(60) Provisional application No. 62/959,453, filed on Jan. 10, 2020.

(51) Int. Cl.
*A47B 21/06* (2006.01)
*A47B 87/00* (2006.01)

(52) U.S. Cl.
CPC ..... *A47B 21/06* (2013.01); *A47B 87/002* (2013.01); *A47B 2021/066* (2013.01); *A47B 2200/0066* (2013.01); *A47B 2200/12* (2013.01)

(58) Field of Classification Search
CPC .... A47B 21/06; A47B 21/00; A47B 2200/008
USPC ..... 108/50.02; 312/223.6
See application file for complete search history.

(56) References Cited

U.S. PATENT DOCUMENTS

| | | | |
|---|---|---|---|
| 1,520,518 | A | 12/1924 | Thomason |
| 2,565,784 | A | 8/1951 | Sheean |
| 2,798,172 | A | 2/1955 | Jones |
| 2,705,179 | A | 3/1955 | Hodgin |
| 2,821,450 | A | 8/1956 | Knoll |

(Continued)

FOREIGN PATENT DOCUMENTS

| | | | | |
|---|---|---|---|---|
| JP | H07276262 | A | 10/1995 | |
| JP | 2009095360 | A * | 5/2009 | ..... A47B 21/06 |

(Continued)

OTHER PUBLICATIONS

International Search Report with Written Opinion for related Application No. PCT/US21/12944 dated Mar. 25, 2021 (13 Pages).

*Primary Examiner* — Jose V Chen
(74) *Attorney, Agent, or Firm* — Michael Best & Friedrich LLP

(57) ABSTRACT

A furniture system includes a first table having a first tabletop and one or more first legs supporting the first tabletop. The first tabletop includes a first upper surface and a first lower surface opposite the first upper surface. The furniture system also includes a second table having a second tabletop and one or more second legs supporting the second tabletop. The second tabletop includes a second upper surface and a second lower surface opposite the second upper surface. A chase is coupled to the first lower surface and the second lower surface to physically connect the first table to the second table. The chase includes a first channel extending therethrough. The first channel is configured to receive one or more cables.

20 Claims, 16 Drawing Sheets

(56) References Cited

U.S. PATENT DOCUMENTS 2,836,475 A 5/1958 Sapp
2,979,686 A 5/1959 Lonmire
3,463,099 A 8/1967 Doucette
3,342,147 A 9/1967 Shettles
3,915,100 A 10/1975 Sullivan
4,105,351 A 8/1978 Anderson
4,165,908 A 8/1979 Cooper et al.
4,296,524 A 10/1981 Horholt et al.
4,325,597 A 4/1982 Morrison
4,382,642 A 5/1983 Burdick
4,408,543 A * 10/1983 Griffin ..... B01L 9/02 108/50.18
4,409,906 A 10/1983 Alneng
4,546,889 A 10/1985 Schoumaker
4,567,698 A 2/1986 Morrison
4,591,289 A 5/1986 Vickers et al.
4,600,173 A * 7/1986 Frascaroli ..... F16B 7/044 248/228.6
4,635,492 A 1/1987 Jebelhart
4,665,836 A 5/1987 Burr
4,748,913 A * 6/1988 Favaretto ..... A47B 17/00 108/50.02
4,838,177 A * 6/1989 Vander Park ..... A47B 21/06 108/50.02
4,915,034 A 4/1990 Grabe et al.
5,086,597 A 2/1992 Kelley et al.
5,103,741 A * 4/1992 Grund ..... A47B 17/033 312/196
5,117,599 A 6/1992 Voss
5,144,888 A 9/1992 Heine et al.
5,152,698 A 10/1992 Juhin et al.
5,172,530 A 12/1992 Fishel et al.
5,182,996 A 2/1993 Gutgsell
5,186,425 A * 2/1993 Keusch ..... A47B 13/02 248/188
5,277,005 A 1/1994 Hellwig et al.
5,277,007 A 1/1994 Hellwig et al.
5,309,686 A 5/1994 Underwood et al.
5,328,260 A 7/1994 Beirise
5,339,747 A 8/1994 Epps
5,391,088 A 2/1995 Tomchak et al.
5,428,928 A 7/1995 Hellwig et al.
5,438,937 A 8/1995 Ball et al.
5,537,290 A 7/1996 Brown et al.
5,560,302 A 10/1996 Diffrient et al.
5,568,773 A * 10/1996 Hung ..... A47B 21/0314 108/50.01
5,792,541 A 8/1998 Herrera
5,794,545 A * 8/1998 McDaniel ..... A47B 13/021 248/188
5,906,420 A 5/1999 Rozier, Jr. et al.
5,943,966 A 8/1999 Machado et al.
5,947,628 A 9/1999 Hansen
5,957,061 A 9/1999 Chang
5,984,566 A 11/1999 Blaha
6,017,228 A 1/2000 Verbeek et al.
6,021,866 A 2/2000 Meeks
6,032,590 A 3/2000 Chen
6,076,317 A 6/2000 Hellwig et al.
6,085,668 A 7/2000 Kanki
6,158,358 A 12/2000 Prendergast
6,170,410 B1 1/2001 Gioacchini et al.
6,182,581 B1 2/2001 Boyce
6,167,664 B1 6/2001 Reuter et al.
6,244,467 B1 6/2001 Lewit et al.
6,253,509 B1 7/2001 Hellwig et al.
6,298,946 B1 10/2001 Yemini et al.
6,324,997 B1 12/2001 Baker
6,367,211 B1 4/2002 Weener et al.
6,382,109 B1 5/2002 Novikoff
6,397,762 B1 6/2002 Goldberg et al.
6,415,723 B1 * 7/2002 Kopish ..... A47B 21/06 108/50.02
6,435,106 B2 * 8/2002 Funk ..... A47B 21/06 108/50.02
6,464,516 B2 10/2002 Baldock
6,543,845 B2 4/2003 Seitz et al.
6,598,542 B2 7/2003 Goldberg et al.
6,717,049 B1 4/2004 Makwinski
6,725,784 B2 * 4/2004 Crinion ..... A47B 87/002 108/50.01
6,911,597 B2 6/2005 Seamans et al.
6,935,247 B2 8/2005 Schaefers et al.
6,968,790 B1 11/2005 Kocsis
7,347,493 B2 3/2008 Mulmed
7,410,373 B2 8/2008 Isaacks
7,557,309 B2 7/2009 Ross et al.
7,665,255 B2 * 2/2010 Dressendorfer ..... H02G 3/0456 108/50.02
7,703,398 B2 4/2010 Brauning et al.
7,765,937 B2 * 8/2010 Weissenrieder ..... A47B 13/021 248/188
7,766,125 B2 8/2010 Fowler
7,806,474 B2 * 10/2010 Wahl ..... A47C 13/005 297/248
7,950,336 B2 5/2011 Phillips
7,966,951 B1 * 6/2011 Black ..... H02G 3/128 108/50.01
7,975,624 B2 * 7/2011 Henriott ..... A47B 21/06 108/50.02
8,132,371 B2 3/2012 Golinski et al.
8,196,526 B2 * 6/2012 Rheault ..... A47B 21/00 108/50.01
8,347,796 B2 1/2013 Jdagawa
8,439,164 B1 5/2013 Esposito
8,584,598 B2 11/2013 Derkoski
8,616,921 B2 12/2013 Byrne et al.
8,708,103 B2 4/2014 Bulley
8,915,198 B2 12/2014 Massimini
8,925,469 B2 * 1/2015 Bennie ..... H02G 3/38 108/50.02
9,161,623 B1 10/2015 Lin
9,247,812 B2 * 2/2016 Parshad ..... A47B 83/001
9,284,729 B2 3/2016 Von Hoyningen Huene et al.
9,427,083 B2 8/2016 Dame et al.
9,488,204 B2 11/2016 King
D783,319 S 4/2017 Udagawa et al.
D786,587 S 5/2017 Udagawa et al.
D787,240 S 5/2017 Udagawa et al.
9,681,763 B2 6/2017 Udagawa et al.
9,685,730 B2 6/2017 Jones et al.
9,730,513 B2 8/2017 Udagawa et al.
D796,216 S 9/2017 Rockwell et al.
9,765,518 B2 9/2017 Von Hoyningen Huene et al.
D799,861 S 10/2017 Krusin
D800,459 S 10/2017 Rockwell et al.
9,803,361 B2 10/2017 Von Hoyningen Huene et al.
9,808,953 B1 10/2017 Sagorski
9,968,187 B2 5/2018 Udagawa et al.
10,045,609 B1 8/2018 Insua
10,842,266 B2 11/2020 Matthai et al.
2003/0020381 A1 1/2003 Cattaneo
2003/0089283 A1 * 5/2003 Okamoto ..... A47B 17/02 108/50.02
2005/0284341 A1 * 12/2005 Klassy ..... A47B 21/00 108/50.02
2006/0042520 A1 3/2006 Stevens et al.
2006/0096506 A1 * 5/2006 Brauning ..... A47B 37/00 108/50.02
2006/0102056 A1 5/2006 Wolfe
2007/0277710 A1 12/2007 Gray et al.
2008/0276841 A1 11/2008 Brauning et al.
2008/0295745 A1 * 12/2008 Hamilton ..... A47B 13/06 108/50.02
2009/0042428 A1 * 2/2009 Henriott ..... A47B 21/06 72/379.2
2009/0273260 A1 * 11/2009 Kemp ..... A47B 21/06 108/50.02
2009/0293773 A1 * 12/2009 Miller ..... A47B 21/06 108/50.02

(56) References Cited

U.S. PATENT DOCUMENTS

| | | | | |
|---|---|---|---|---|
| 2010/0024687 | A1* | 2/2010 | Preiss | A47B 21/06 108/50.02 |
| 2010/0024688 | A1* | 2/2010 | Kitada | A47B 21/06 108/154 |
| 2010/0171398 | A1 | 7/2010 | Berthiaume et al. | |
| 2011/0226165 | A1 | 9/2011 | Ballard | |
| 2011/0272213 | A1 | 11/2011 | Taron | |
| 2011/0297052 | A1 | 12/2011 | Martin et al. | |
| 2011/0298339 | A1 | 12/2011 | Udagawa et al. | |
| 2012/0103234 | A1 | 5/2012 | Schiavello et al. | |
| 2014/0001822 | A1 | 1/2014 | Thorson et al. | |
| 2014/0106610 | A1 | 4/2014 | Byrne et al. | |
| 2014/0238277 | A1* | 8/2014 | Fishman | A47B 21/06 108/106 |
| 2014/0283715 | A1 | 9/2014 | Sevadjian | |
| 2014/0366782 | A1 | 12/2014 | Battey | |
| 2016/0079721 | A1 | 3/2016 | Jones et al. | |
| 2016/0255957 | A1* | 9/2016 | Tsuchiyama | A47B 13/02 |
| 2016/0345724 | A1 | 12/2016 | White et al. | |
| 2016/0348358 | A1 | 12/2016 | Udagawa et al. | |
| 2017/0290418 | A1 | 10/2017 | Udagawa et al. | |
| 2017/0354247 | A1* | 12/2017 | Matthai | F16B 2/12 |
| 2019/0246791 | A1* | 8/2019 | Lundberg | A47B 21/06 |
| 2019/0357676 | A1* | 11/2019 | Matthai | H01R 25/006 |
| 2021/0106133 | A1* | 4/2021 | Anderson | A47B 21/06 |
| 2021/0204690 | A1* | 7/2021 | Lim | A47B 13/02 |
| 2021/0330074 | A1* | 10/2021 | LaDuke | A47B 21/06 |

FOREIGN PATENT DOCUMENTS

| | | | |
|---|---|---|---|
| WO | WO9719617 | A2 | 6/1997 |
| WO | WO0013548 | A1 | 9/1998 |
| WO | WO0191609 | A2 | 12/2001 |
| WO | WO2004008911 | A2 | 1/2004 |
| WO | WO2007114774 | A1 | 10/2007 |
| WO | WO2018101875 | A1 | 6/2018 |

* cited by examiner

CHASE FOR CONNECTING TABLES

CROSS-REFERENCE TO RELATED APPLICATIONS

This application claims priority to U.S. Provisional Patent Application No. 62/959,453, filed Jan. 10, 2020, the entire contents of which are incorporated by reference herein.

FIELD OF THE INVENTION

The present invention relates to tables of a furniture system and, more particularly, to mechanisms for connecting tables of a furniture system together.

SUMMARY

The present embodiment provides, in one aspect, a furniture system including a first table having a first tabletop and one or more first legs supporting the first tabletop. The first tabletop includes a first upper surface and a first lower surface opposite the first upper surface. The furniture system also includes a second table having a second tabletop and one or more second legs supporting the second tabletop. The second tabletop includes a second upper surface and a second lower surface opposite the second upper surface. A chase is coupled to the first lower surface and the second lower surface to physically connect the first table to the second table. The chase includes a first channel extending therethrough. The first channel is configured to receive one or more cables.

The present embodiment provides, in another aspect, a chase for physically connecting a first table to a second table. The chase includes an upper portion removably couplable to the first table and the second table. The upper portion includes a first bracket for coupling the upper portion to the first table and a second bracket for coupling the upper portion to the second table. A lower portion is removably couplable to the upper portion. The lower portion includes a first channel extending therethrough. The first channel is configured to receive one or more cables.

The present embodiment provides, in yet another aspect, a chase for physically connecting a first table to a second table. The chase includes an upper portion removably couplable to the first table and the second table. The upper portion includes a first bracket for coupling the upper portion to the first table and a second bracket for coupling the upper portion to the second table. A lower portion is removably couplable to the upper portion. The lower portion includes a first channel extending therethrough. The first channel is configured to receive one or more cables. A cover is removably coupled to the lower portion. The cover is positioned to cover a bottom of the first channel. A first cable management tray is positioned adjacent the first channel and extending outwardly from the first channel. The first cable management tray is configured to be positioned below the first table. A second cable management tray is positioned adjacent the first channel and extending outwardly from the first channel. The second cable management tray is configured to be positioned below the second table. A second channel is spaced apart from the first channel. The second channel provides a location for removably coupling a workspace accessory to the chase.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
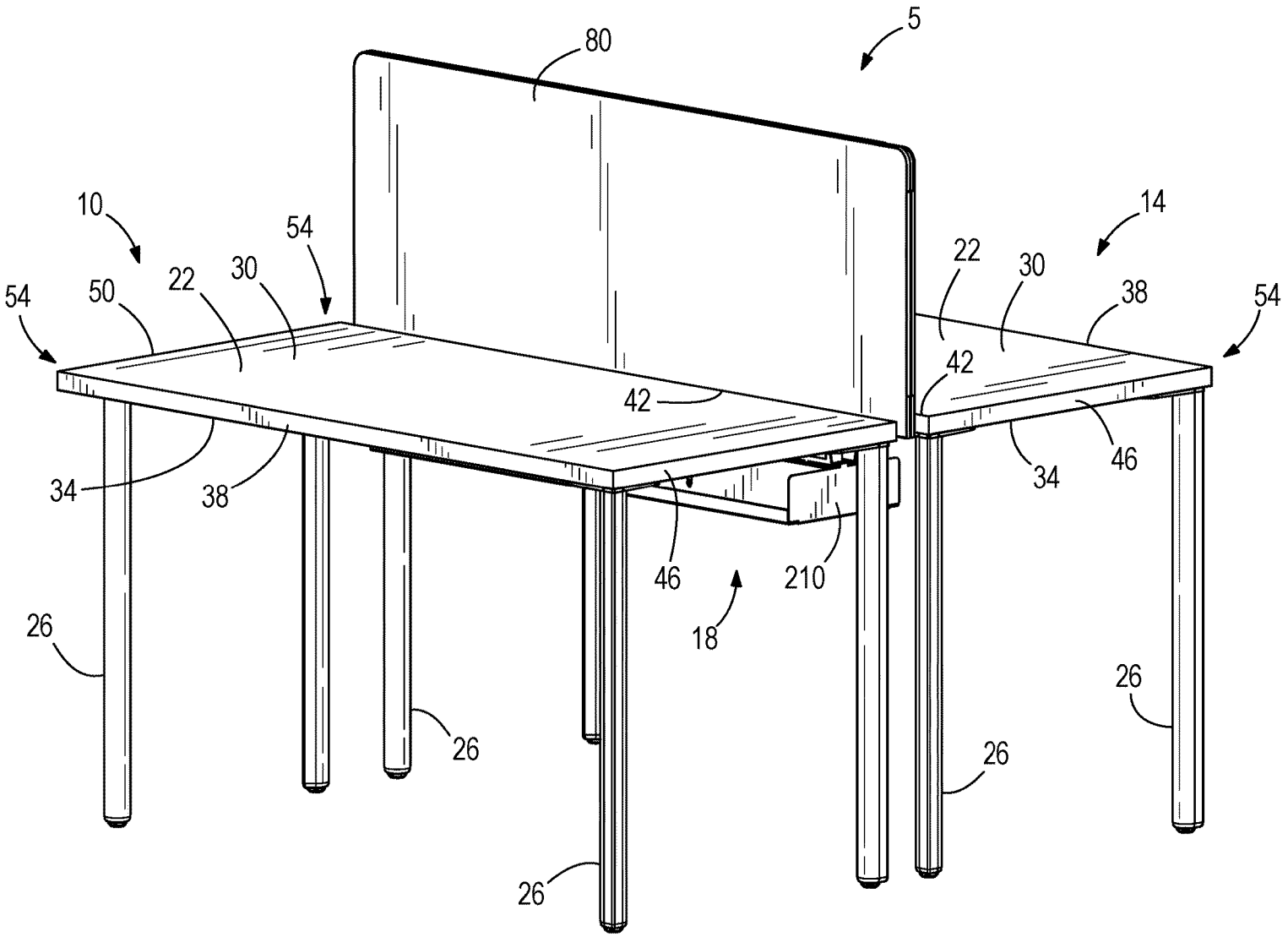
FIG. 1 is a perspective view of a furniture system including two tables and a chase.
Figure 2:
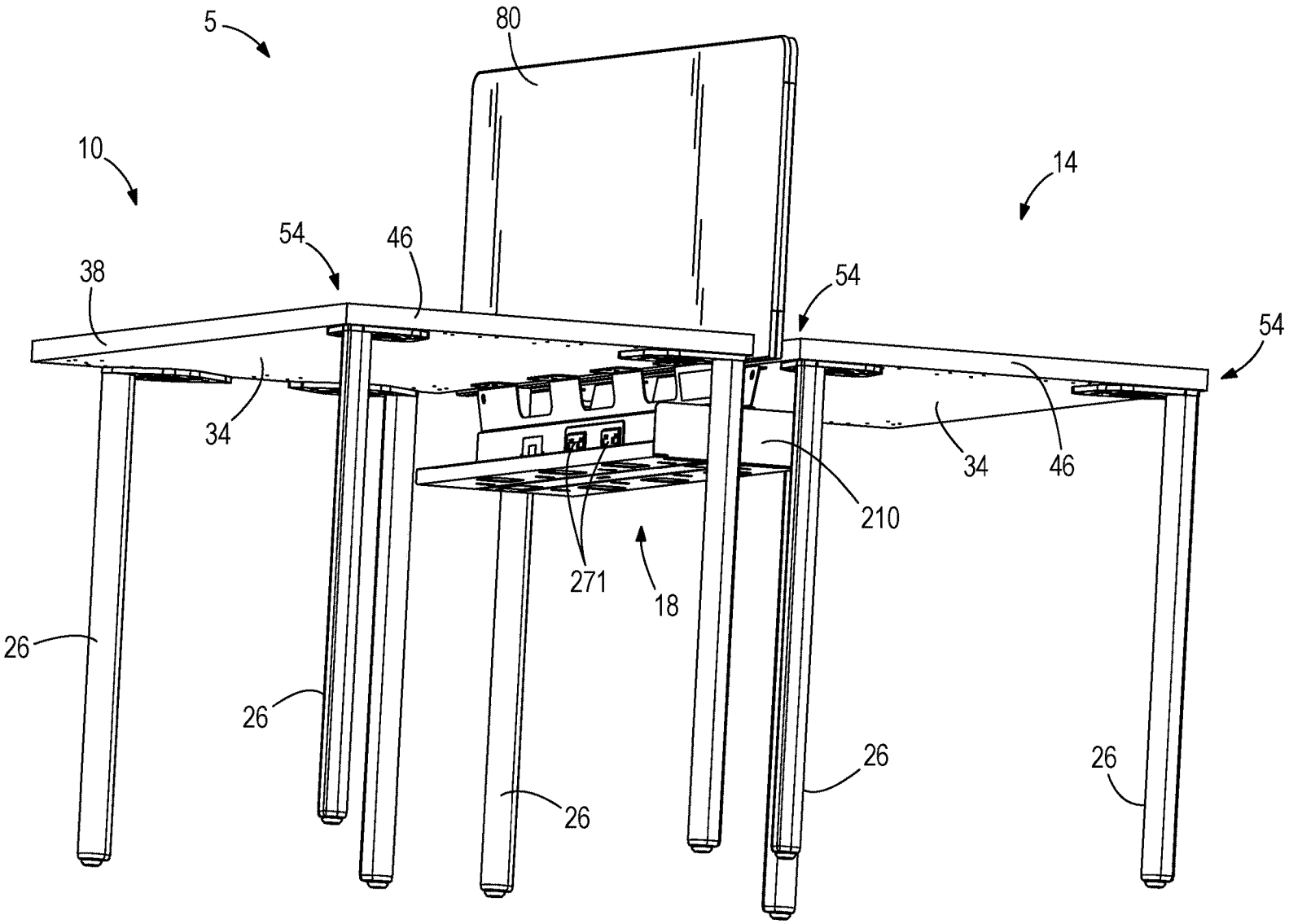
FIG. 2 is another perspective view of the furniture system of FIG. 1.
Figure 3:
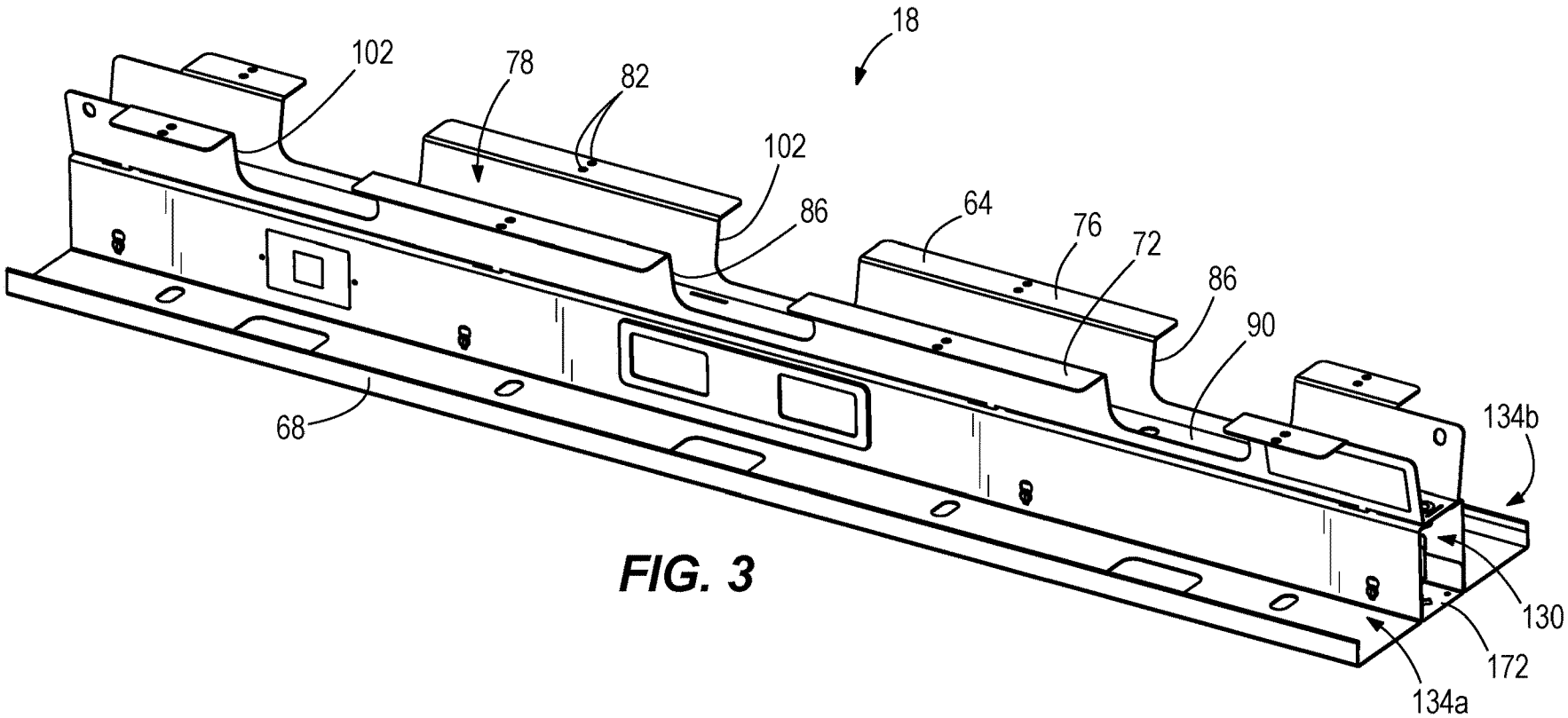
FIG. 3 is a perspective view of the chase of FIG. 1.
Figure 17:
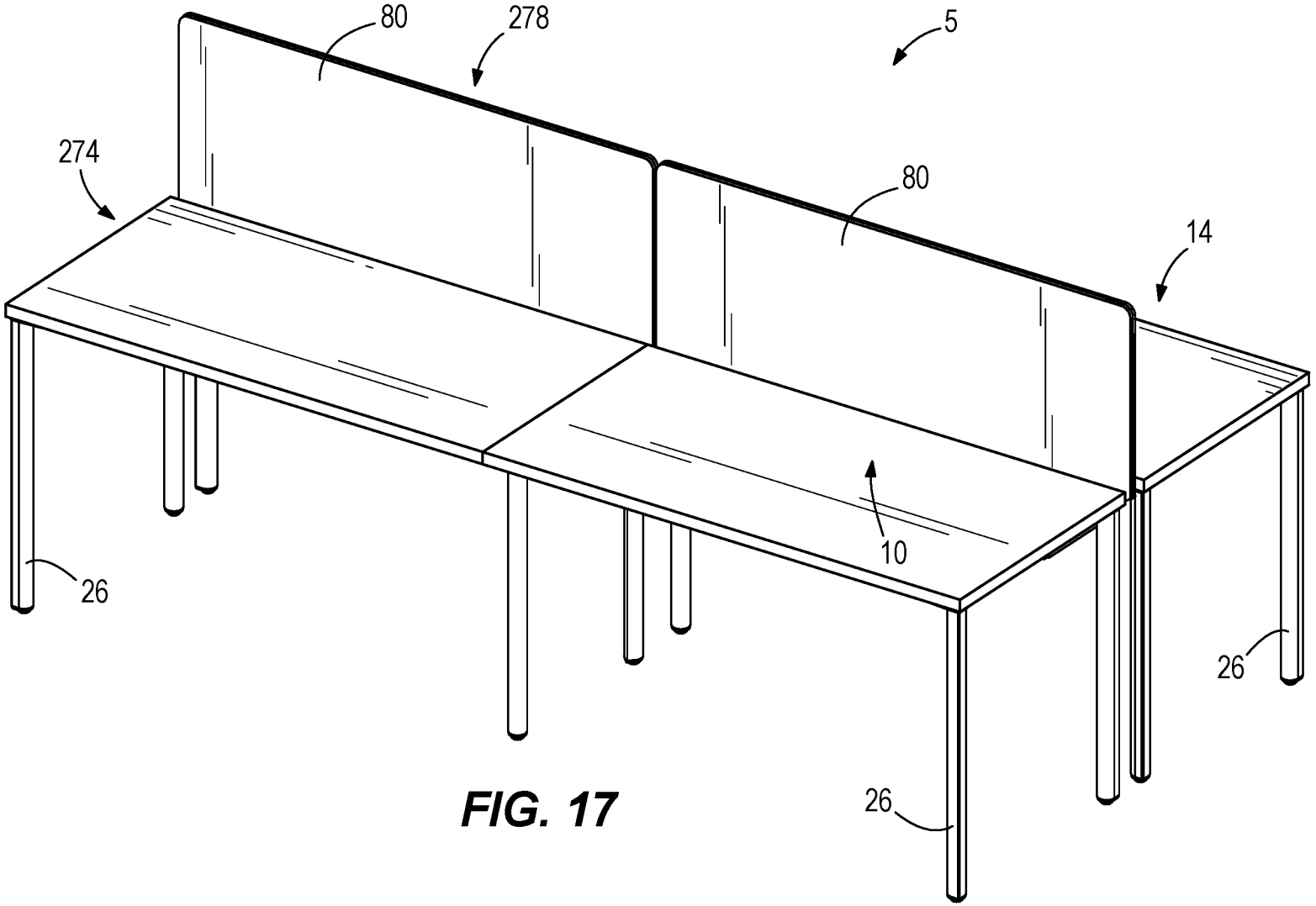
FIG. 17 is a top perspective view of another furniture system with additional tables and chases.
Figure 18:
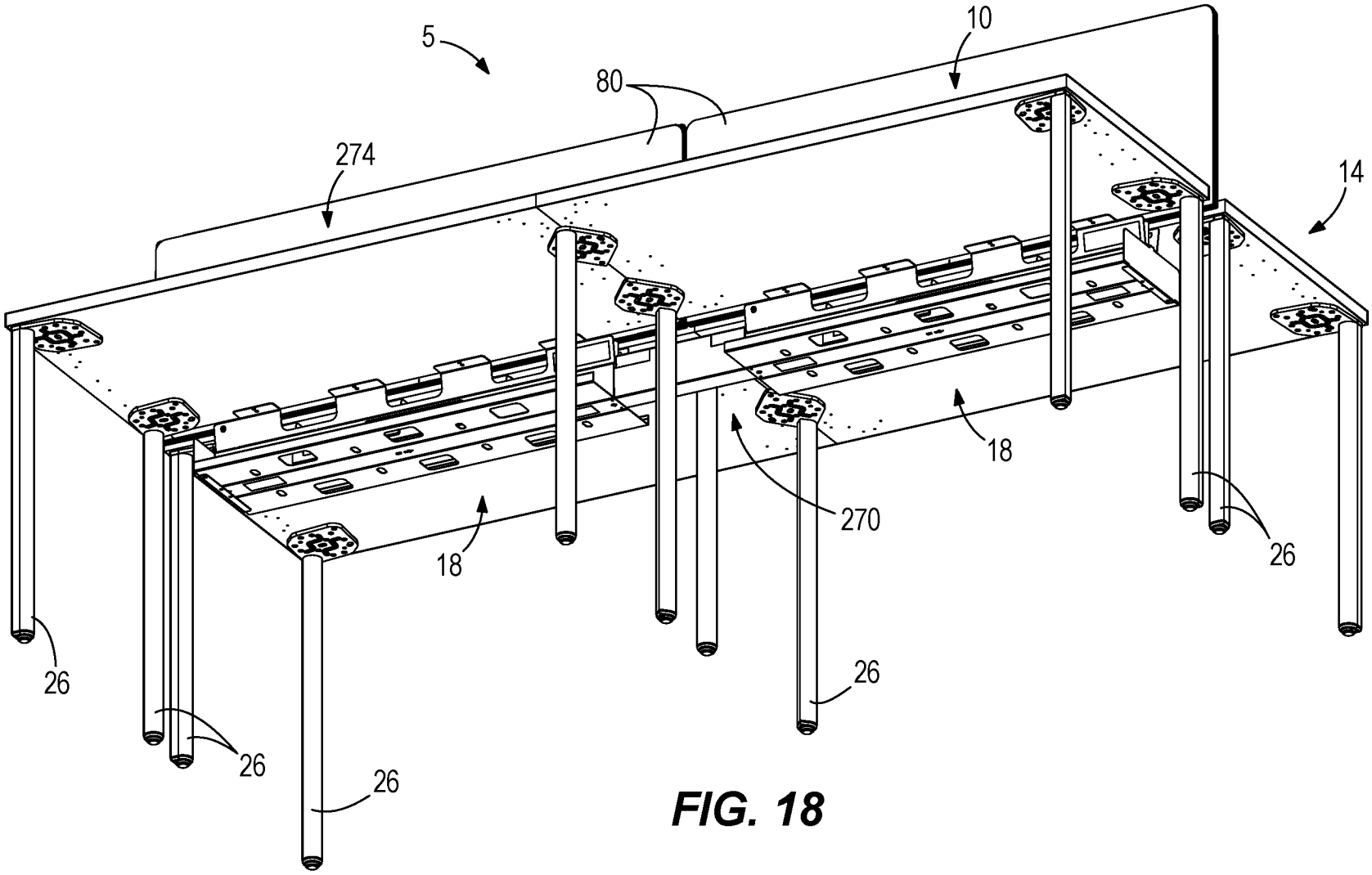
FIG. 18 is a bottom perspective view of the furniture system of FIG. 17.

FIGS. 1 and 2 illustrate a furniture system 5 including a first table 10, a second table 14, and a chase 18 (may also be referred to herein as an "accessory bridge"). In the illustrated embodiment, the first and second tables 10, 14 are generally the same shape and size. In other embodiments, the first and second tables 10, 14 may be different. The tables 10, 14 are held together (i.e., physically) by the chase 18. The chase 18 is also removable from the tables 10, 14 such that the tables 10, 14 may be used independently. In other words, each of the illustrated tables 10, 14 is a freestanding unit that does not rely on other structures for support. In some embodiments (such as shown in FIG. 17), more than two tables may be held together by the chase 18 or by multiple chases 18.

Each table 10, 14 includes a tabletop 22 and one or more legs 26. In the illustrated embodiment, the tabletops 22 are substantially rectangular in shape. In other embodiments, the tabletops 22 may be substantially circular in shape, octagonal in shape, or the like. Each tabletop 22 includes an upper surface 30, a lower surface 34, a first side edge 38, a second side edge 42, a first end edge 46, and a second end edge 50. The upper surface 30 may also be referred to as a work surface of the respective table 10, 14. The lower surface 34 may also be referred to as an underside of the respective table 10, 14. The first side edge 38 is the edge of the table 10, 14 adjacent a user. The first side edge 38 and the second side edge 42 are longer than the first end edge 46 and the second end edge 50. The chase 18 is coupled to the lower surface 34 of the tabletop 22 such that portions of the chase 18 are not visible from above the tabletop 22. The accessory bridge or chase 18 may be coupled to the lower surface 34 adjacent either the first side edge 38 or the second side edge 42. For example, the first side edge 38 of one of the tables 10, 14 may be located adjacent the second side edge 42 of another one of the tables 10, 14. In additional embodiments, the chase 18 may be coupled to the lower surface 34 adjacent the first end edge 46 or the second end edge 50.

In the illustrated embodiment, each table 10, 14 includes four legs 26. Each of the legs 26 is positioned at a corner 54 of the tabletop 22. In other embodiments, each table 10, 14 may include fewer than four legs or more than four legs. When the chase 18 is coupled to two of the tables 10, 14, the chase 18 is positioned between two of the legs 26 on each table 10, 14. In other words, the chase 18 is situated between two of the corners 54 of the second side edge 42 of the first table 10 and is situated between two of the corners 54 of the second side edge 42 of the second table 14.

With reference to FIGS. 3-6, the chase 18 (or accessory bridge) includes an upper portion 64 and a lower portion 68. The upper portion 64 includes a first bracket 72 and a second bracket 76. The first bracket 72 is removably coupled to the first table 10. The second bracket 76 is removably coupled to the second table 14. The upper portion 64 further includes an upper channel 78 disposed between the first bracket 72 and the second bracket 76. The upper channel 78 is an upwardly facing channel. The upper channel 78 provides a location for supporting workspace accessories, such as cables, privacy screens, and the like, as further discussed below. In the illustrated embodiment, the workspace accessory is a privacy screen 80. As such, the upper channel 78 may be referred to as an accessory channel.

Figure 6:
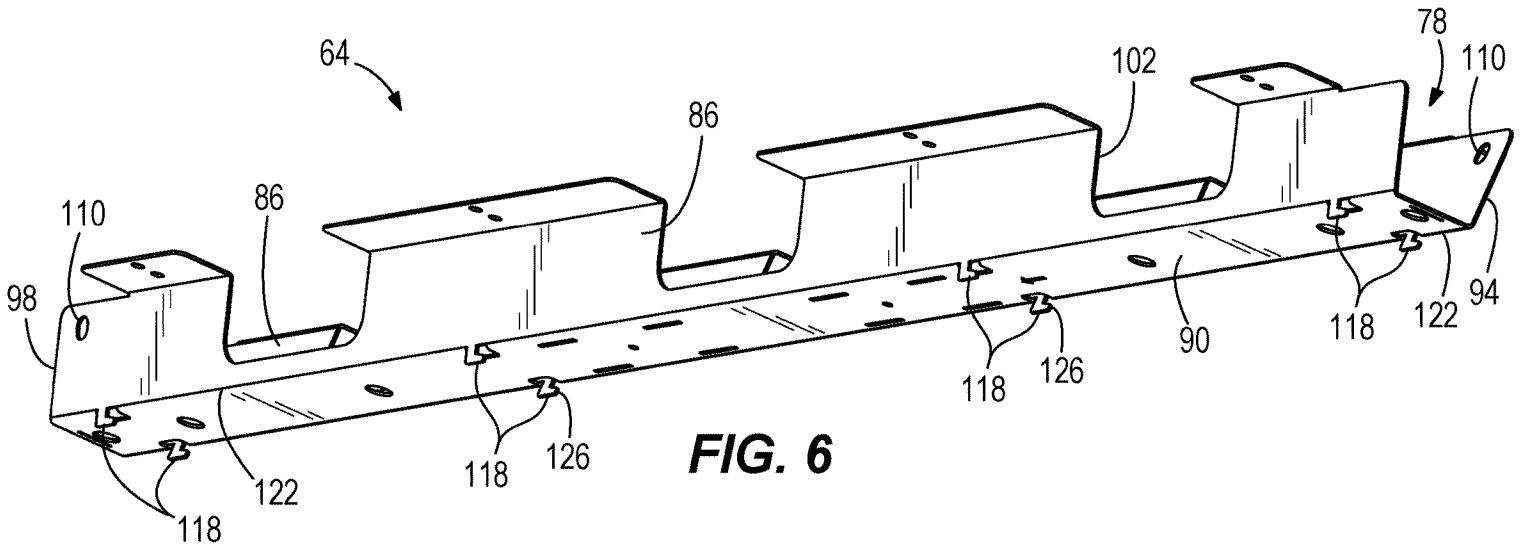
FIG. 6 is a perspective view of an upper portion of the chase of FIG. 3.

With reference to FIG. 6, the upper portion 64 of the chase 18 is composed of a continuous sheet of material. In the illustrated embodiment, the continuous sheet of material is metal, although, in other embodiments, the material may be plastic, composite, or the like. The material is bent to form the first bracket 72, the second bracket 76, and the upper channel 78. In other embodiments, the upper portion 64 may be an extruded piece. The upper channel 78 is formed between the first bracket 72 and the second bracket 76. The first bracket 72 and the second bracket 76 are coplanar. When the first bracket 72 and the second bracket 76 are coupled to the lower surface 34 of the tabletop 22, the first bracket 72 and the second bracket 76 are coplanar with the lower surface 34 of the tabletop 22. The first and second brackets 72, 76 include holes 82 (FIG. 3) that are configured to receive fasteners (e.g., screws, etc.). The fasteners may be inserted into the holes 82 to secure the upper portion 64 of the chase 18 to the lower surface 34 of the tabletop 22. In additional embodiments, the upper portion 64 may be secured to the lower surface 34 with adhesive, snap fittings, or the like.

With reference to FIGS. 6-9, the upper channel 78 of the upper portion 64 is defined by side walls 86 and a bottom wall 90 and includes a first channel end 94 and a second channel end 98. The bottom wall 90 is substantially flat and forms a plane that is substantially parallel with the plane formed by the first and second brackets 72, 76. The side walls 86 connect the first and second brackets 72, 76 to the bottom wall 90. Each side wall 86 is angled relative to the plane formed by the first and second brackets 72, 76. In the illustrated embodiment, with particular reference to FIG. 9, each side wall 86 is oriented at a non-perpendicular angle A relative to the plane, but may alternatively be oriented at a perpendicular angle relative to the plane. Due to the side walls 86 being angled, the bottom wall 90 has a width that is smaller than a space between the first and second brackets 72, 76 at the plane.

A distance between the first channel end 94 and the second channel end 98 defines a length L of the upper portion 64. The first channel end 94 and the second channel end 98 of the upper channel 78 provide access to the upper channel 78 when the upper portion 64 is coupled to the lower surfaces 34 of the tables 10, 14.

Along the length L of the upper portion 64, cut-outs 102 are disposed at regular intervals. The cut-outs 102 remove portions of the side walls 86 and portions of the first and second brackets 72, 76 at regular intervals along the length L of the upper portion 64. The cut-outs 102 provide access to the upper channel 78 and the bottom wall 90 when the upper portion 64 is coupled to the lower surface 34 of the tabletop 22. Additionally, along the length L of the upper portion 64, holes 106, holes 107, and holes 108 (FIG. 8) are disposed at regular intervals in the bottom wall 90. The holes 106 and holes 107 are substantially circular in shape. The holes 108 are substantially rectangular in shape. In other embodiments, the holes 106, the holes 107, and/or the holes 108 may be circular, rectangular, octagonal, or the like. The holes 106 facilitate connection of the workspace accessories to the chase 18. Additionally, holes 110 (FIG. 6) may be provided in the side walls 86 of the upper channel 78 along the length L of the upper portion 64. In the illustrated embodiment, the upper portion 64 includes one hole 110 positioned proximate the first channel end 94 and another hole 110 proximate the second channel end 98.

Figure 8:
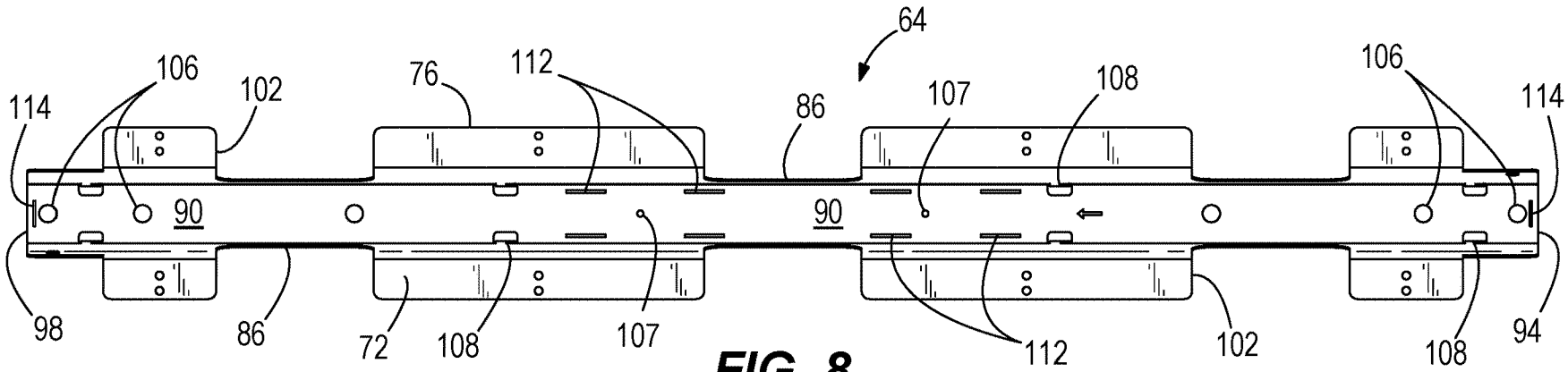
FIG. 8 is a top view of the upper portion of the chase of FIG. 6.

With particular reference to FIG. 8, the upper portion 64 further includes a plurality of slots 112, 114 defined by the bottom wall 90. The slots 112 are disposed at regular intervals along the length L of the bottom wall 90. The upper portion 64 includes two slots 114, each one positioned proximate the first channel end 94 or the second channel end 98, respectively.

Figure 7:
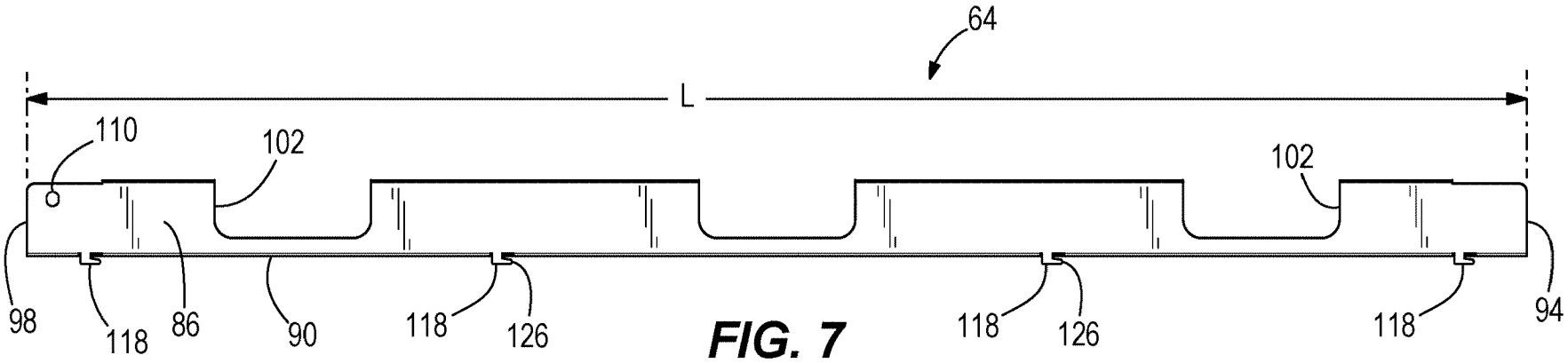
FIG. 7 is a side view of the upper portion of the chase of FIG. 6.
Figure 9:
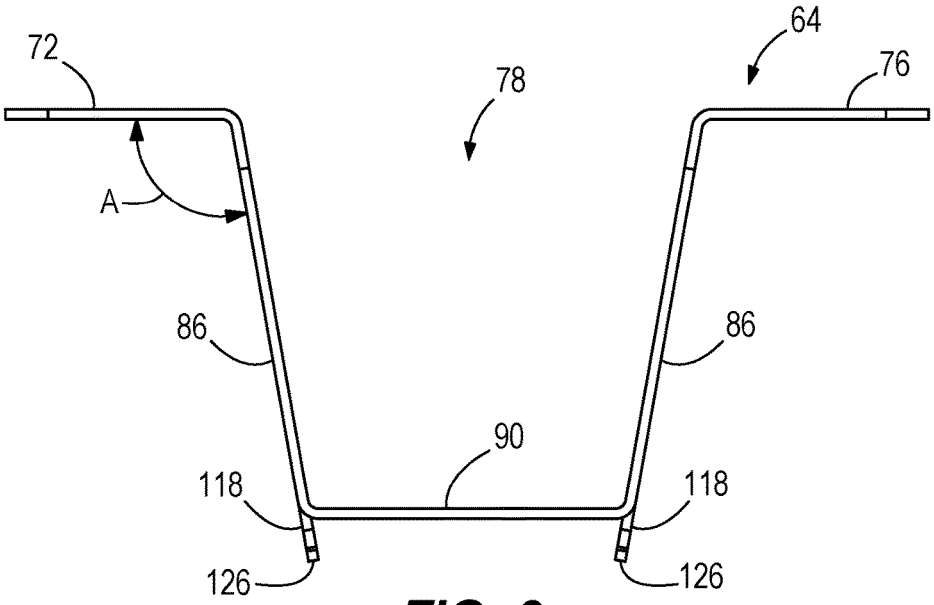
FIG. 9 is an end view of the upper portion of the chase of FIG. 6.

Along the length L of the bottom wall 90, a plurality of protrusions 118 extend outwardly from the bottom wall 90 at regular intervals. The protrusions 118 are positioned at corners 122 (FIG. 6) of the bottom wall 90 such that pairs of two protrusions 118 are positioned at regular intervals. Each protrusion 118 is at the same angle relative to the bottom wall 90 as the angle A that the side wall 86 is at relative to the bottom wall 90 (FIG. 9). Each protrusion 118 includes a leg or hook 126 that extends in a direction parallel to the bottom wall 90. Each of the hooks 126 extends toward the first channel end 94 (FIG. 7).

Figure 10:
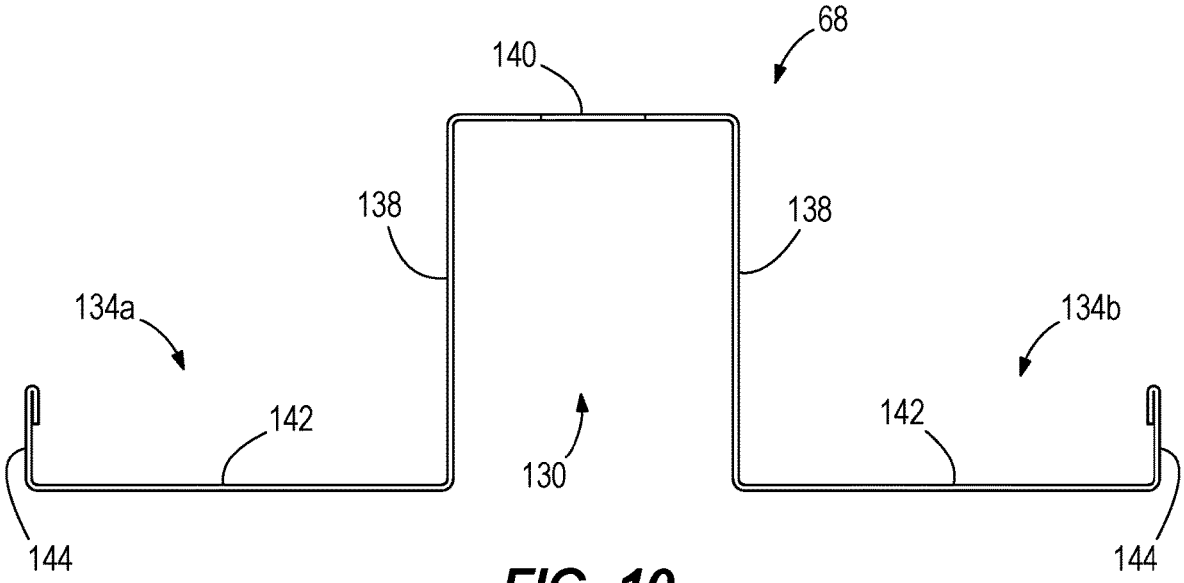
FIG. 10 is an end view of a lower portion of the chase of FIG. 3.
Figure 11:
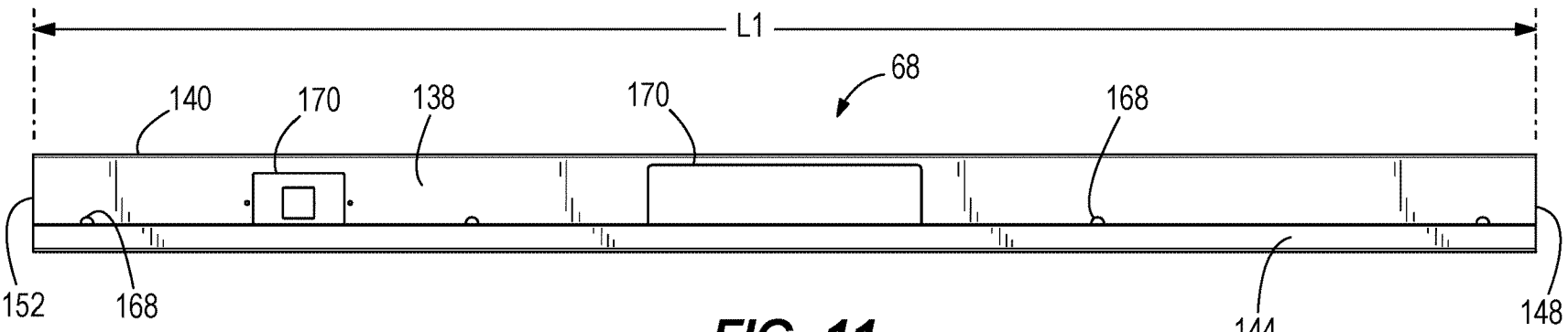
FIG. 11 is a side view of the lower portion of the chase of FIG. 10.
Figure 12:
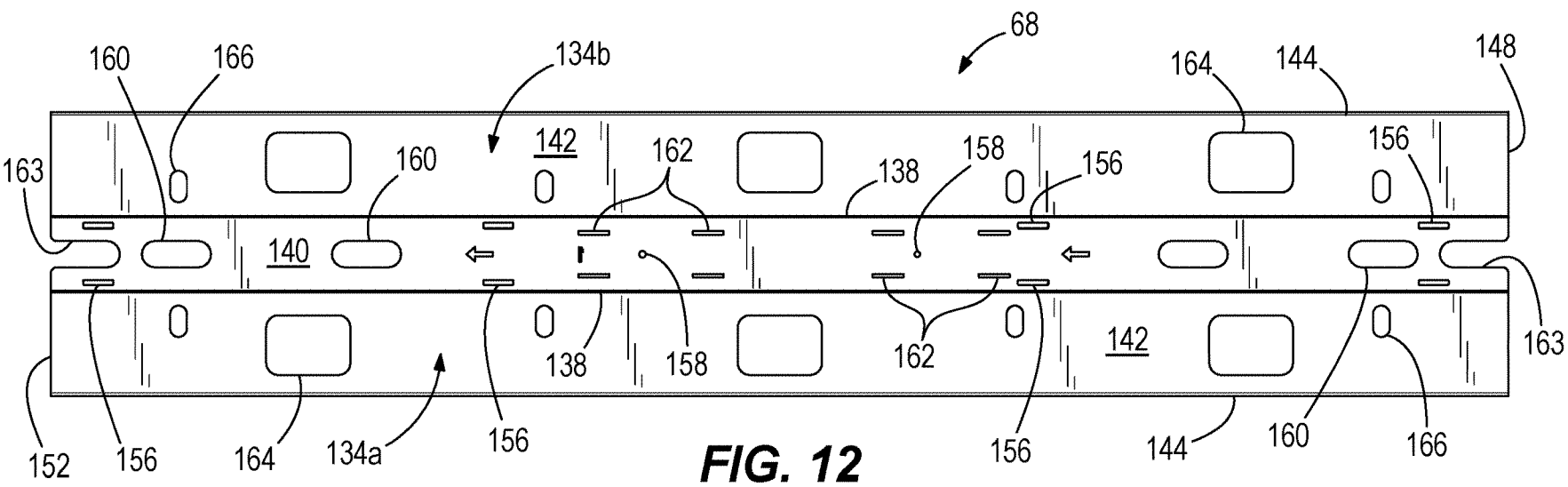
FIG. 12 is a top view of the lower portion of the chase of FIG. 10.
Figure 13:
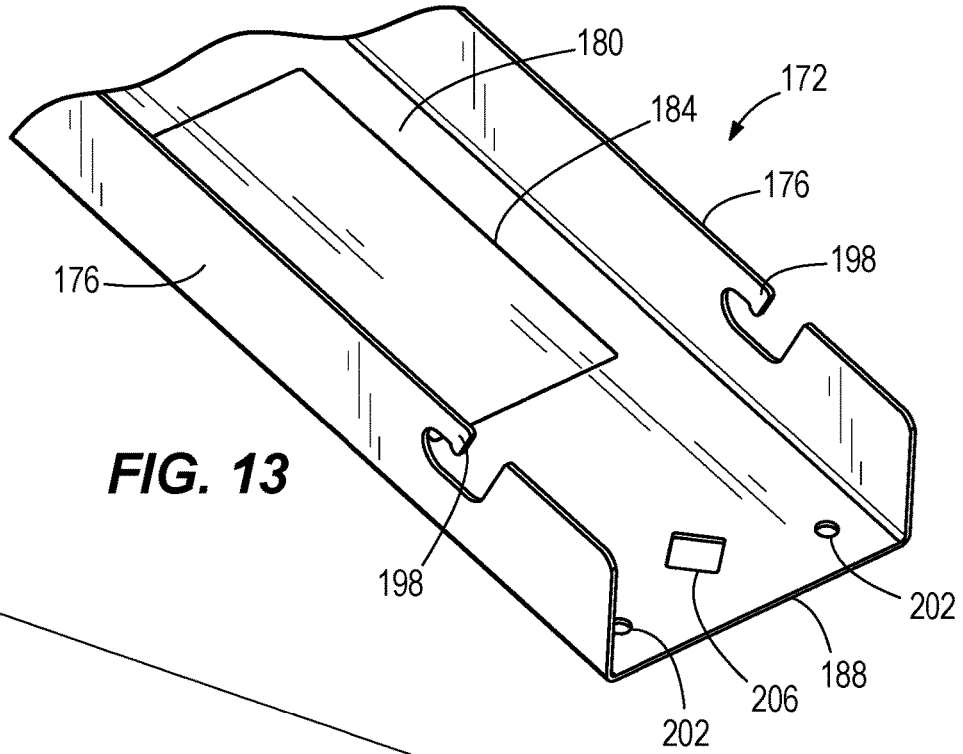
FIG. 13 is a perspective view of a portion of a cover of the chase of FIG. 3.

With reference to FIGS. 10-12, the lower portion 68 includes a lower channel 130 and one or more trays 134*a*, 134*b*. The lower portion 68 is formed of a continuous sheet of material that is bent. In the depicted embodiments, the material is a metal. In other embodiments, the material may be plastic, composite, or the like. In some embodiments, the lower portion 68 may be an extruded piece.

The lower channel 130, or downwardly-facing channel, extends between the first tray 134*a* and the second tray 134*b*. The lower channel 130 is defined by side walls 138 extending downwardly from a top wall 140. The illustrated side walls 138 are perpendicular to a plane created by the top wall 140. The side walls 138 connect the lower channel 130 to first and second trays 134*a*, 134*b*.

The illustrated lower portion 68 includes the first tray 134*a* and the second tray 134*b* positioned on opposite sides of the lower channel 130. As such, the trays 134*a*, 134*b* are integrally formed as a single piece with the lower portion 68. Each of the trays 134*a*, 134*b* extend laterally outward from the lower channel 130. When the chase 18 is connected to the tables 10, 14, the first tray 134*a* is positioned under the first table 10 and the second tray 134*b* is positioned under the second table 14. The first tray 134*a* and the second tray 134*b* provide a storage location for cables, wires, power cords, power supplies, and the like. As such, each tray 134*a*, 134*b* may be referred to as a cable management tray. In other embodiments, the lower portion 68 may include multiple trays positioned under the same table 10, 14.

With continued reference to FIGS. 10-12, the first and second trays 134*a*, 134*b* each include a tray bottom wall 142 and an outer side wall 144. The tray bottom walls 142 of the first and second trays 134*a*, 134*b* extend from the side walls 138. The tray bottom walls 142 are perpendicular to the side walls 138. The tray bottom walls 142 each couple the side wall 138 to the side wall 144. The illustrated outer side wall 144 is perpendicular to the tray bottom wall 142. The outer side wall 144 includes an end portion that is curved inwardly toward the tray bottom wall 142.

The lower portion 68 extends between a first lower end 148 and a second lower end 152. The first and second lower ends 148, 152 provide access to the first and second trays 134*a*, 134*b*, and the lower channel 130. A distance between the first lower end 148 and the second lower end 152 defines a length L1 of the lower portion 68. In the depicted embodiment, the length L1 of the lower portion 68 is substantially the same as the length L of the upper portion 64. In other embodiments, the length L1 of the lower portion 68 may be different than the length L of the upper portion 64.

With particular reference to FIG. 12, the lower channel 130 includes rectangular openings 156 disposed at regular intervals along the length of the top wall of the lower portion 68. The location of each of the rectangular openings 156 corresponds to one of the protrusions 118 (FIG. 7) of the upper portion 64. The protrusions 118 may be received in the rectangular openings 156. In addition, holes 158, elongated holes 160 and elongated slots 162 are disposed at regular intervals along the length L1 of the top wall 140 of the lower portion 68. The holes 158 are configured to align with the holes 107 of the upper portion 64, and the elongated slots 162 are configured to align with the elongated slots 112 of the upper portion 64 when the upper and lower portions 64, 68 are coupled together. In addition, the lower portion 68 includes notches 163 positioned at the first lower end 148 and the second lower end 152. The illustrated notches 163 are defined by the top wall 140, but may alternatively by defined by the trays 134*a*, 134*b*.

Furthermore, each of the first and second trays 134*a*, 134*b* include rectangular tray holes 164 and elongated holes 166 that are disposed along the length L1 of the lower portion 68 at regular intervals. The rectangular holes 164 and the elongated holes 166 of the first and second trays 134*a*, 134*b* are positioned in the tray bottom walls 142. In some embodiments, the lower portion 68 may not include the holes 160, 164, 166, the slots 162, and/or the notches 163. In other embodiments, the holes 160, 164, 166, the slots 162, and/or the notches 163 may differ in shape and/or may or may not be disposed at regular intervals. Additionally, the lower portion 68 further includes holes 168 (FIG. 4) provided at regular intervals in the side walls 138 of the lower channel 130 along the length L1 of the lower portion 68. Each hole 168 is shaped to receive a fastener. The holes 168 are configured to facilitate coupling to a cover, as further discussed below.

The side walls 138 of the lower portion 68 include apertures 170 (FIG. 11) extending through a thickness of the side walls 138. The apertures 138 may be covered by knock-out pieces that may be removed from the side walls 138, as needed. The apertures 170 are disposed along a length of the lower portion 68. In the depicted embodiment, the apertures 170 are sized to receive power outlets (e.g., power outlets 271; FIG. 2). In some embodiments, the apertures 170 may be sized to receive alternative accessories. In other embodiments, the side walls 138 may not include the apertures 170. Additional apertures may be disposed at alternative locations of the lower portion 68.

To couple the upper portion 64 to the lower portion 68, the protrusions 118 are received by the rectangular openings 156. More specifically, the hooks 126 of the protrusions 118 are first received by the rectangular openings 156. The lower portion 68 is then slid toward the second channel end 98 of the upper portion 64 (e.g., to the left from the frame of reference of FIG. 4). The lower portion 68 includes indicia (e.g., arrows; FIG. 12) positioned on the top wall 140 for indicating the direction of movement of the lower portion 68 relative to the upper portion 64 to the user. In this position, the hooks 126 of the protrusions 118 maintain the upper portion 64 in position relative to the lower portion 68 in a vertical direction from the frame of reference of FIG. 4. The chase 18 further includes fasteners received in the aligned holes 107 of the upper portion 64 and the holes 158 of the lower portion 68. The fasteners are configured to secure the upper portion 64 to the lower portion 68. The fasteners are configured to inhibit the upper and lower portions 64, 68 from separating. The upper portion 64 may then be coupled to the underside 34 of the work surface 22 via the fasteners.

With reference to FIGS. 3, 4, 13, and 14, a cover 172 is removably coupled to the lower channel 130 of the lower portion 68. The cover 172 includes channel side walls 176 and a channel bottom wall 180. The channel bottom wall 180 may include one or more apertures 184 (e.g., covered by knock-out pieces) for providing access to the lower channel 130 and/or supporting power outlets disposed along an outside surface of the cover 172, for example. The cover 172 is substantially U-shaped. In other embodiments, the cover 172 may have a different shape. The cover 172 is positioned to cover a bottom of the lower channel 130. The cover 172 closes the lower channel 130 such that cables or alternative accessories may be held within the lower channel 130. The cables may be defined as including cords, wires, or the like. In other embodiments, routing channels may be provided within the lower channel 130. The routing channels allow the wires to be stored in the lower channel 130 when the cover 172 is not coupled to the lower channel 130.

Figure 4:
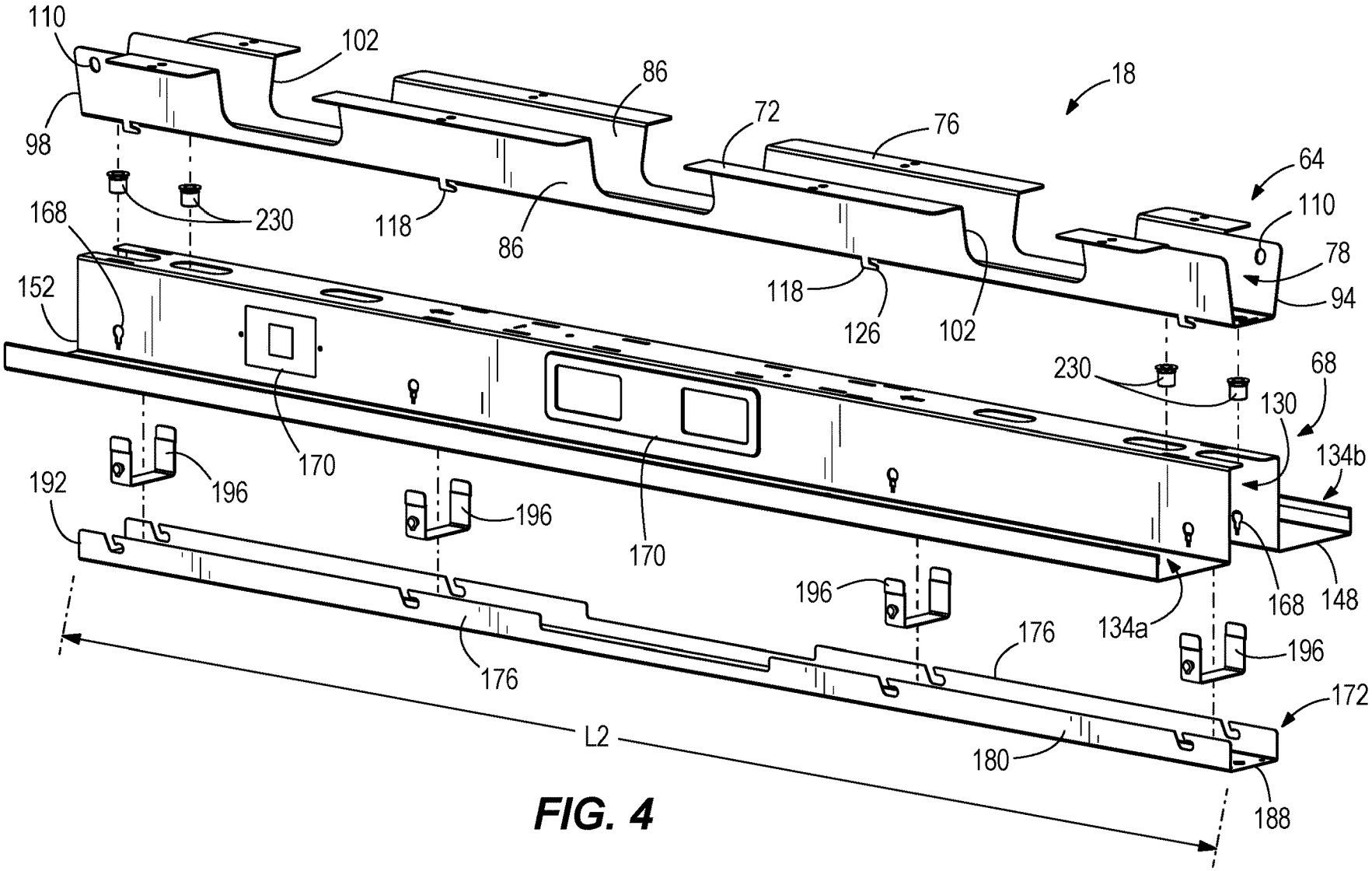
FIG. 4 is an exploded view of the chase of FIG. 3.
Figure 5:
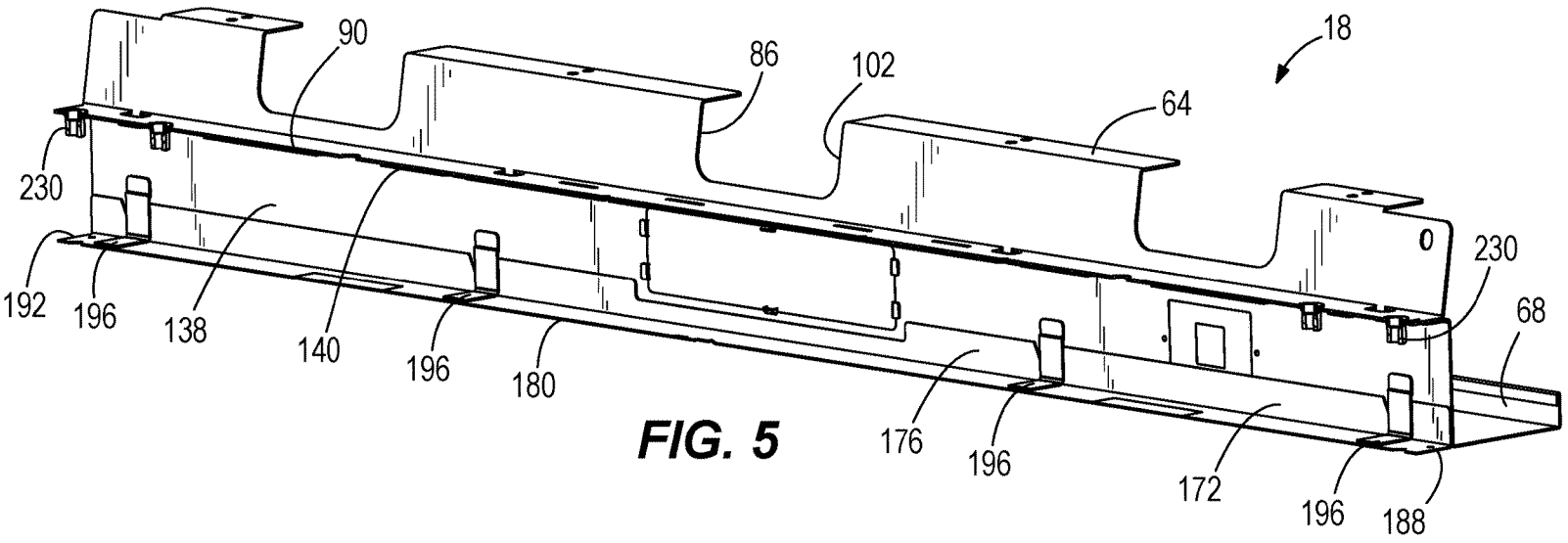
FIG. 5 is a cross-sectional view of the chase of FIG. 3.

The cover 172 extends between a first end 188 and a second end 192 (FIG. 4). A distance between the first end 188 and the second end 192 defines a length L2 of the cover 172. In the depicted embodiment, the length L2 of the cover 172 is substantially the same as the length L of the upper portion 64 and the length L1 of the lower portion 68. In other embodiments, the length L2 of the cover 172 may be the same or different than the length L of the upper portion 64 and/or the length L1 of the lower portion 68.

With continued reference to FIGS. 3, 4, 13, and 14, the cover 172 may be removably coupled to the lower channel 320 via fasteners, adhesive, or the like. For example, the cover 172 may be removably coupled to the lower channel 130 via fasteners received by the holes 168 positioned in the side walls 138 of the lower channel 130. In the illustrated embodiment, as shown in FIG. 4, the cover 172 is coupled to the lower portion 68 by U-shaped fasteners 196 positioned within the lower channel 130. In addition, the cover 172 includes hook portions 198 positioned proximate the first and second ends 188, 192, respectively. The hook portions 198 define elongated notches within the cover 172. The elongated notches of the cover 172 are aligned with the respective holes 168 of the side walls 138 of the lower portion 68 for allowing the hook portions 198 to engage with head portions of the fasteners 196 when the lower portion 68 and the cover 172 are coupled together. As such, the hook portions 198 may facilitate alignment of the cover 172 relative to the lower portion 68.

The cover 172 further includes holes 202 adjacent the first and second ends 188, 192, respectively, of the cover 172. In particular, the holes 202 are positioned between the hook portions 198 and the first and second ends 188, 192. The cover 172 further includes holes 206 that align with elongated holes 160 of the lower portion 68.

To couple the cover 172 to the lower portion 68, the fasteners 196 are positioned within the lower channel 130 of the lower portion 68, and the head portions of the fasteners 196 are positioned within the holes 168 in the side walls 138 of the lower portion 68. Each of the fasteners 196 is then moved downwardly (e.g., from the frame of reference of FIG. 4) such that the head portion of each respective fastener 196 is positioned proximate a bottom end of the respective hole 168 of the lower portion 68. The cover 172 is then positioned to cover the bottom of the lower channel 130 such that the hook portions 198 of the cover 198 are aligned with the holes 168, and the cover 172 is moved to position the head portions of the fasteners 196 in the elongated notches of the cover 172. More specifically, the cover 172 is slid upwardly toward the upper portion 64 and then the cover 172 is slid toward the second lower end 152 of the lower portion 68 (e.g., to the left from the frame of reference of FIG. 4) to position the head portions of the fasteners 196 within the elongated notches of the cover 172. Accordingly, the hook portions 198 of the cover 172 inhibit the cover 172 from separating from the fasteners 168 while coupling the cover 172 to the lower portion 68. In addition, the hook portions 198 may allow a user to couple the cover 172 from below the chase 18 (e.g., while the upper portion 64 is coupled to the underside 34 of the work surface 22).

The cover 172 may also include indicia (e.g., arrows) positioned on the channel bottom wall 180 for indicating the direction of movement of the lower portion 68 to the user. In the illustrated embodiment, the cover 172 includes the arrows indicating movement of the cover 172 toward an off position (e.g., movement of the cover 172 to the right toward the first lower end 142 of the lower portion 68) for decoupling the cover 172 from the lower portion 68.

Additional accessories may be coupled to the upper portion 64 and/or the lower portion 68. For example, tray covers may be coupled to ends of the first and second trays 134*a*, 134*b*. The tray covers may be coupled via fasteners being received by holes positioned proximate the ends of the first and second trays 134*a*, 134*b*. Additionally, channel coverings may be provided to cover the channel ends 94, 98 of the upper channel 78, the lower ends 148, 152 of the lower channel 130 and trays 134*a*, 134*b*, and/or the ends 188, 192 of the cover 172.

Figure 14:
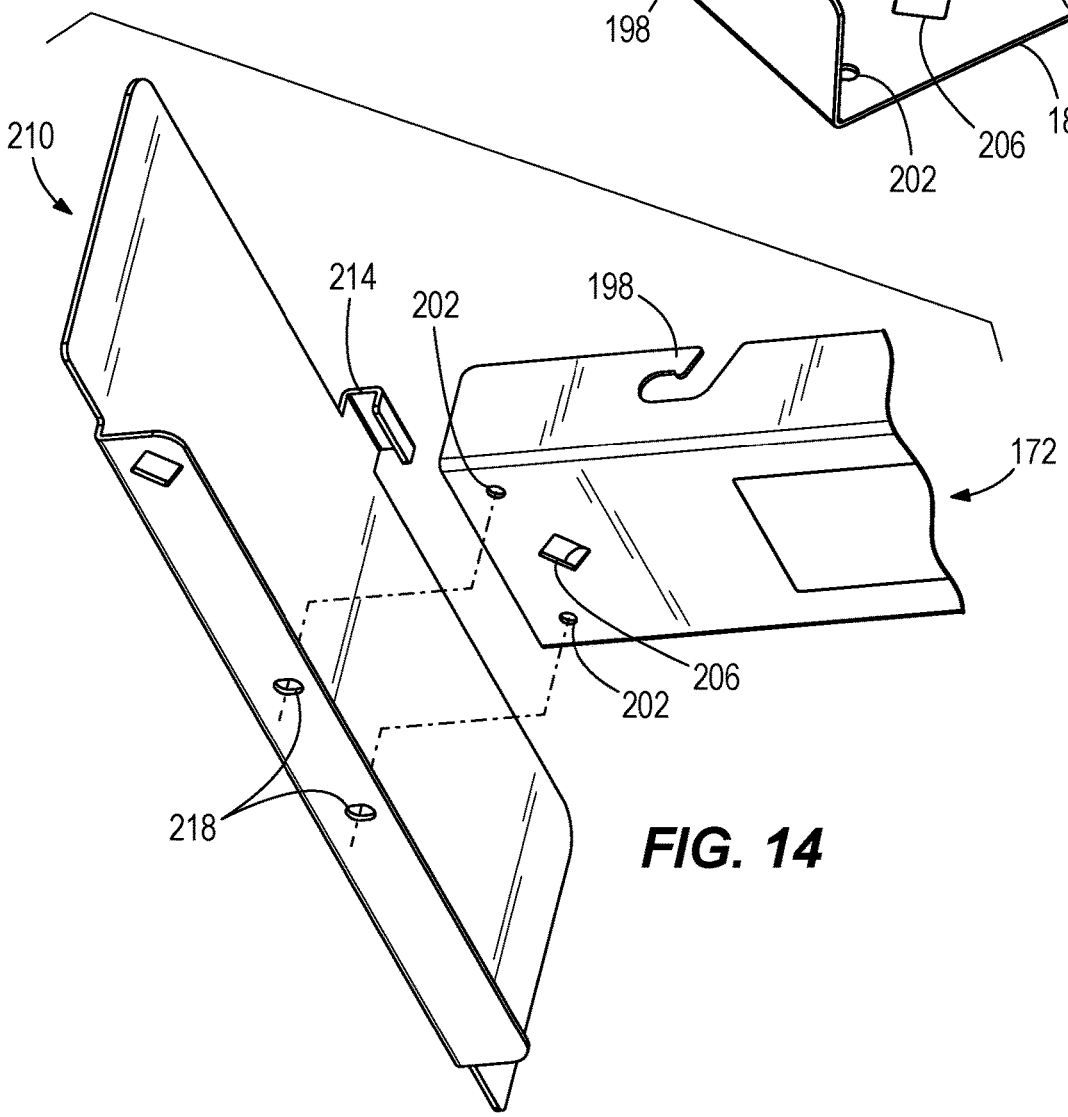
FIG. 14 is an exploded view of the portion of the cover of FIG. 13 and an end cap removably couplable to the cover.

For example, as shown in FIG. 14, the chase 18 includes an end cap 210 coupled to the chase 18. In particular, the end cap 210 includes a projection 214 configured to be received in the respective slot 114 of the upper portion 64 proximate the first channel end 94 or the second channel end 98. In other embodiments, the channel coverings may be coupled via fasteners received by holes positioned proximate the first lower end 148 and the second lower end 152. Furthermore, the illustrated end cap 210 includes holes 218 aligned with holes 202 of the cover 172. The aligned holes 202, 218 are configured to receive fasteners for removably coupling the end cap 210 to the cover 172.

With reference to FIG. 2, the end cap 210 extends past the side walls 138 of the lower channel 130 when the end cap 210 is coupled to the bottom wall 90 of the upper portion 64. In addition, the end cap 210 extends to cover the first tray 134*a* and the second tray 134*b* at the first lower end 148. As such, the end cap 210 is configured to cover the respective lower end 148, 152 of the lower portion 68. In other embodiments, the end cap 210 may be configured to also cover the respective channel end 94, 98 of the upper portion 64.

In the following paragraphs, the connection of the workspace accessory, such as the privacy screen 80, will now be discussed. With reference to FIG. 4, the chase 18 includes a plurality of cylindrical fasteners 230 (e.g., rivet nut) received in the respective holes 106 of the upper portion 64. In addition, the fasteners 230 are received in the elongated holes 160 of the lower portion 68 when the upper portion 64 and the lower portion 68 are coupled together. In particular, the fasteners 230 may be inserted from above the bottom wall 90 vertically downward into the aligned holes 106, 160 from the frame of reference of FIG. 3 after the upper and lower portions 64, 68 are coupled together. The fasteners 230 have internal threads.

Figure 15:
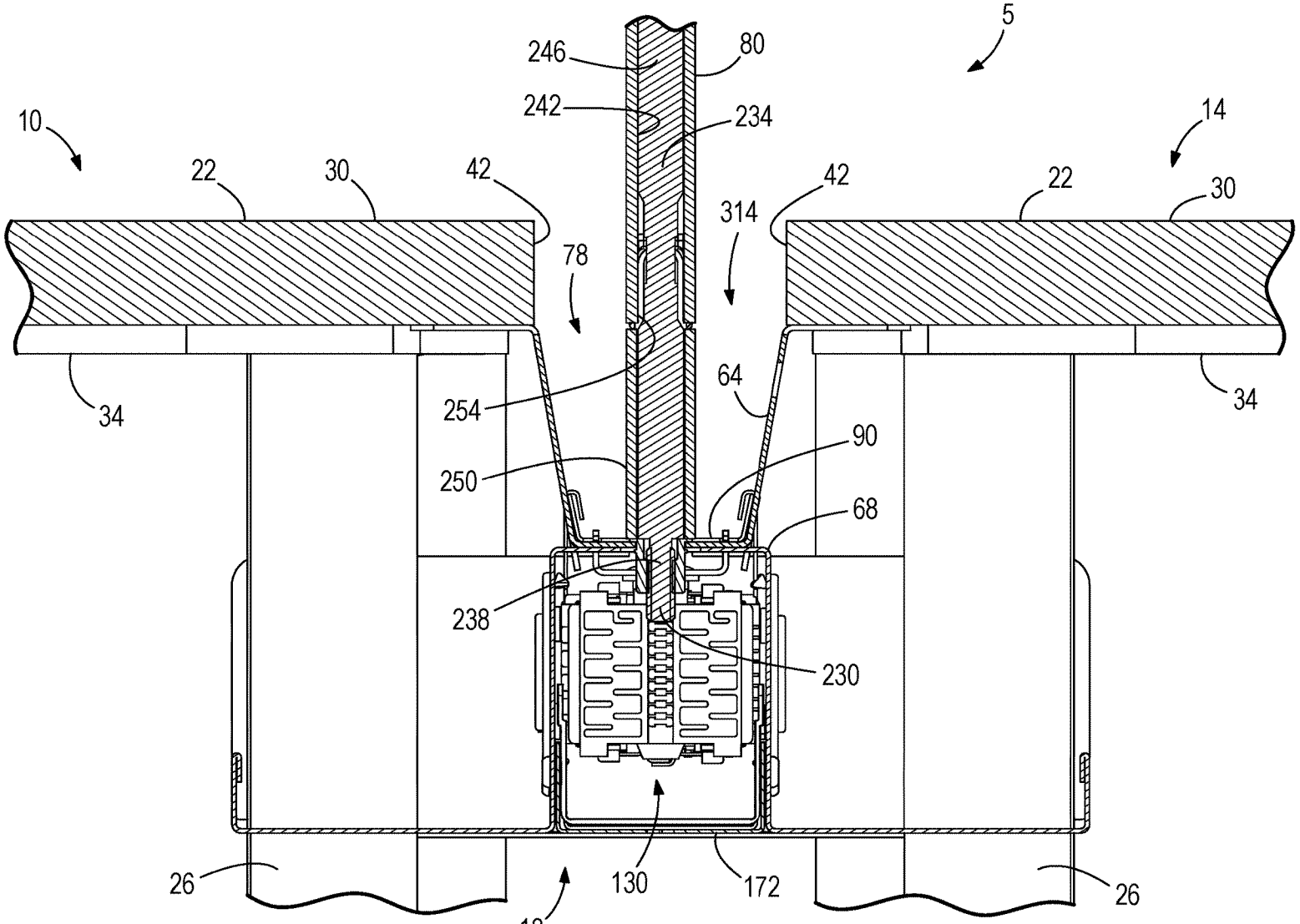
FIG. 15 is a cross-sectional view of a portion of the furniture system of FIG. 1, illustrating a connection between a furniture accessory and the chase.
Figure 16:
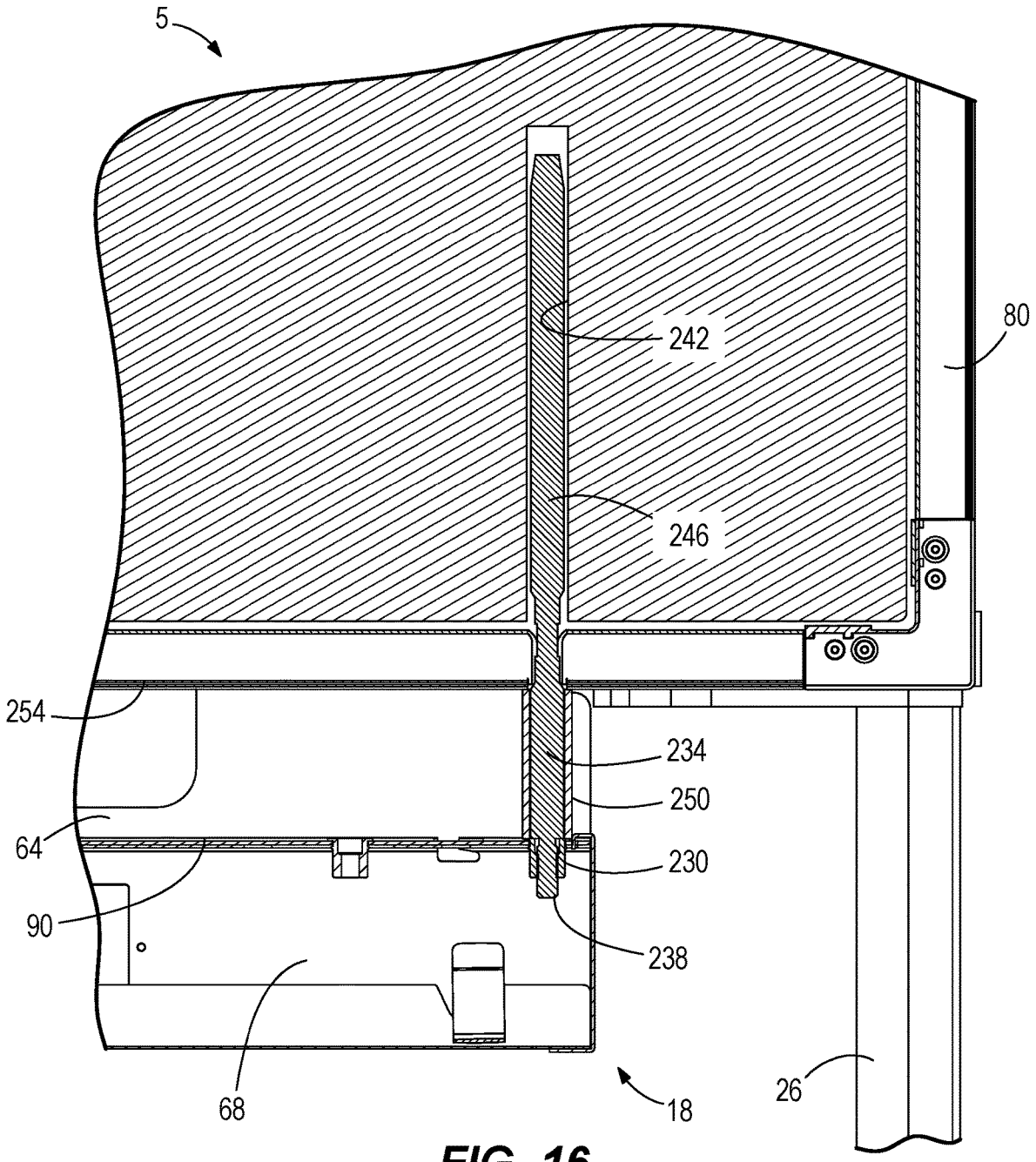
FIG. 16 is another cross-sectional view of a portion of the furniture system of FIG. 1, illustrating the connection between the furniture accessory and the chase.

With reference to FIGS. 15 and 16, the furniture system 5 includes a plurality of connection members 234 (e.g., poles). Each connection member 234 has a threaded end portion 238 for threadably coupling the connection member 234 to the respective fastener 230. More specifically, the end portion 238 of the connection member 234 is threaded into the fastener 230. In addition, the screen 80, or other workspace accessory, includes a plurality of cavities 242 extending therewithin. Each cavity 242 is configured to receive a portion 246 of the connection member 234 opposite the end portion 238. In the illustrated embodiment, the furniture system 5 further includes a plurality of spacer members 250 positioned between the bottom wall 90 of the upper portion 64 of the chase 18 and a bottom edge 254 of the screen 80. Accordingly, the screen 80 is supported by and removably coupled to the chase 18 by the fasteners 230 and the connection members 234.

Figure 19:
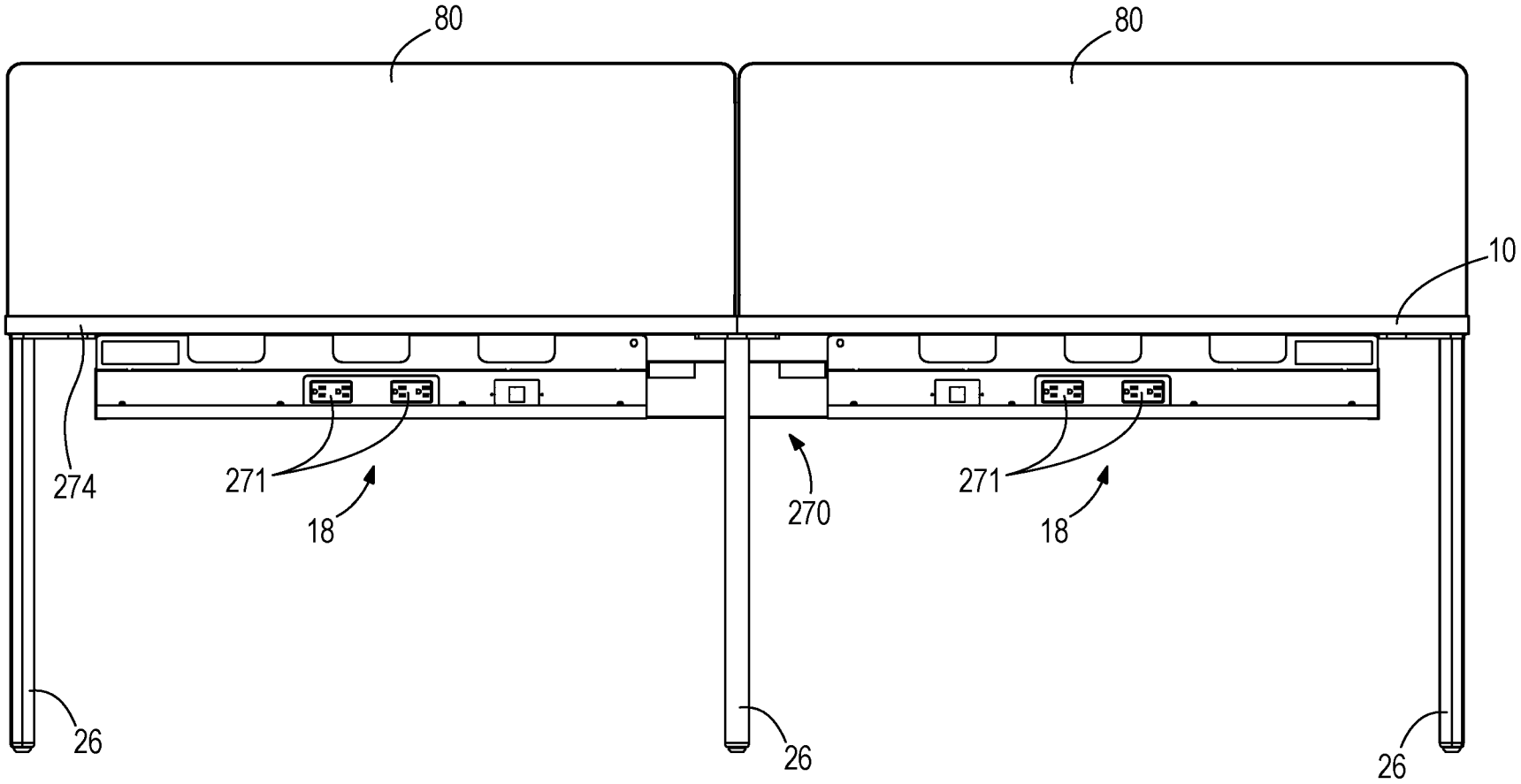
FIG. 19 is a side view of the furniture system of FIG. 17

With reference to FIGS. 18-21, the furniture system 5 may include more than two tables 10, 14. When more than two tables 10, 14 are assembled using the chase 18, the chase 18 may additionally include a bridge piece 270. The bridge piece 270 may be removably coupled to the first chase 18 (e.g., coupled to the first and second tables 10, 14) and a second chase 18 coupled to a third table 274 and a fourth table 278. When the bridge piece 270 is coupled to the first chase 18 and the second chase 18, the bridge piece 270 links the multiple chases 18 together (FIG. 19). In other words, the bridge piece 270 couples the first and second tables 10, 14 to the third and fourth tables 274, 278.

Figure 20:
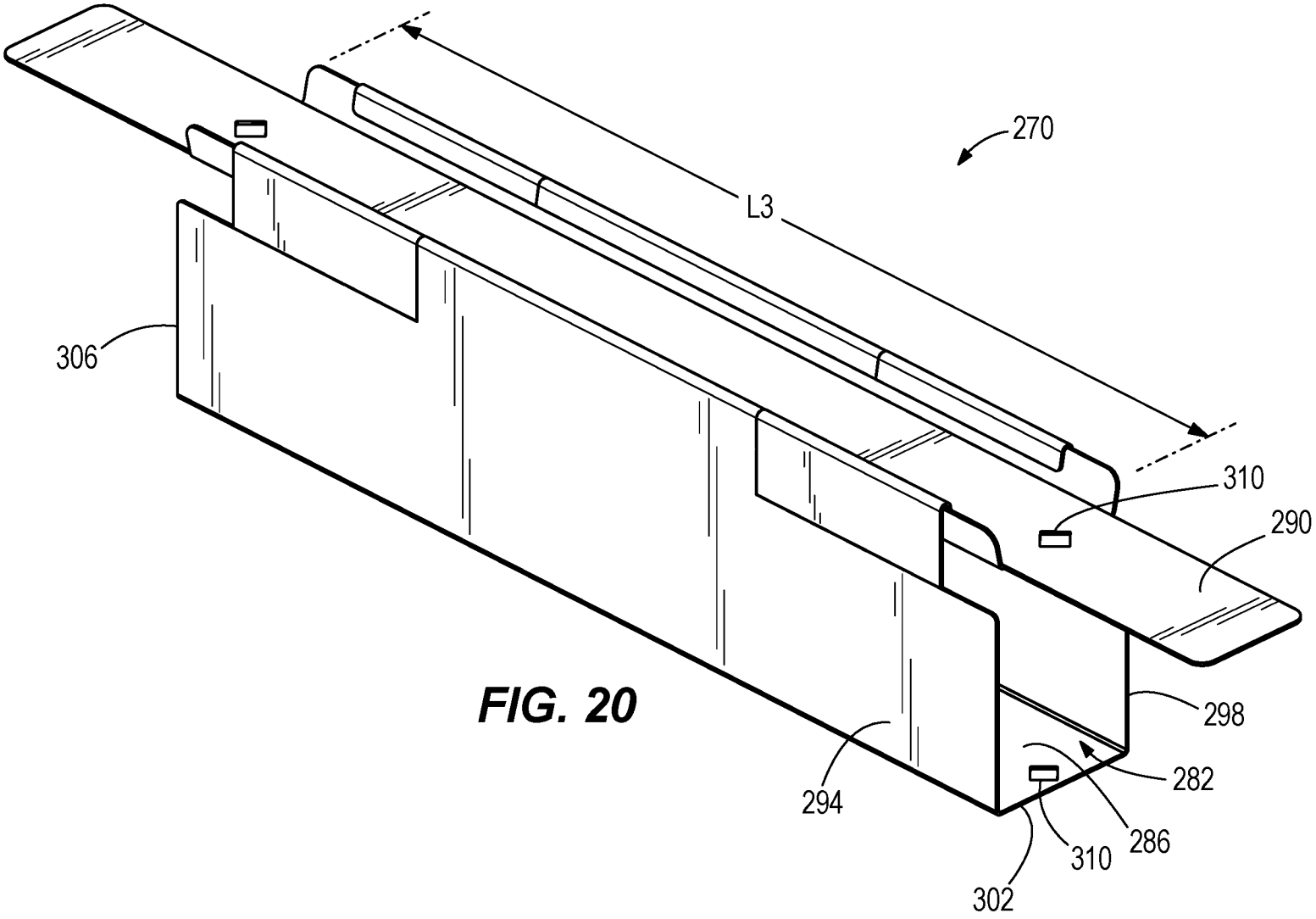
FIG. 20 is a perspective view of a bridge piece for connecting a first chase to a second chase.
Figure 21:
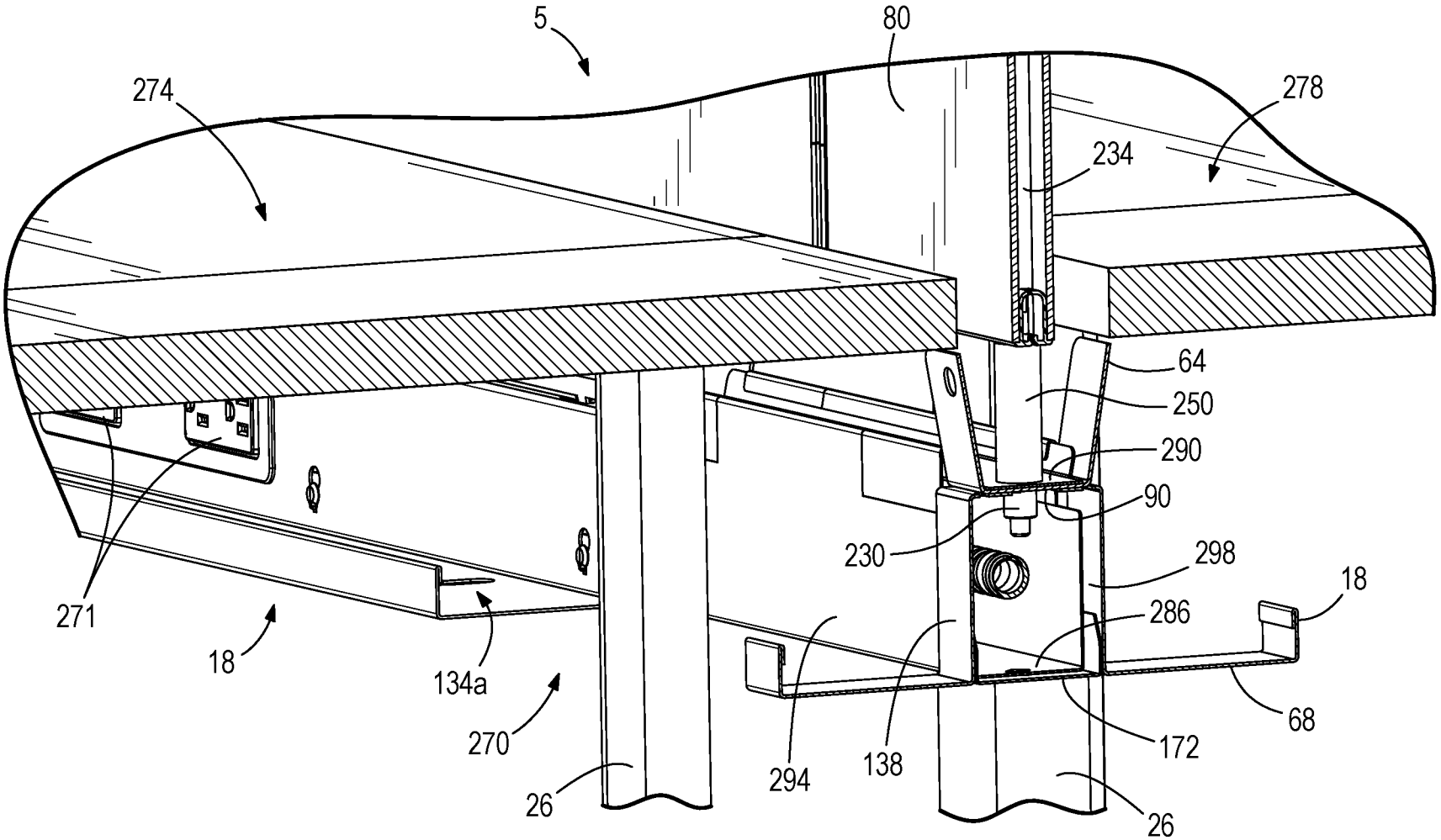
FIG. 21 is a cross-sectional view of a portion of the furniture system of FIG. 17, illustrating a connection between the bridge piece and the first chase.

With particular reference to FIG. 20, the bridge piece 270 includes a center channel 282. The center channel 282 is defined by a bottom panel 286, a top panel 290, a first side panel 294, and a second side panel 298. In the illustrated embodiment, the first side panel 294 and the second side panel 298 are integrally formed with sides of the bottom panel 286, and the top panel 290 is formed as a separate piece. In other embodiments, the center channel 282 may be formed by one or more panels. The center channel 282 is sized to be received by the lower channel 130 of the lower portion 68. More specifically, as shown in FIG. 21, the panels 286, 294, 298 are between the side walls 138 and the cover 172 within the lower channel 130. In other embodiments, the center channel 282 may be sized to be received by the first and second trays 134*a*, 134*b*. When the bridge piece 270 is received in the lower channel 130, the bottom panel 286 engages with the cover 172. In addition, the first and second side panels 294, 298 partially overlap the side walls 138.

The bridge piece 270 extends between a first end 302 and a second end 306 opposite the first end 302. A distance between the first end 302 and the second end 306 defines a length L3 of the bridge piece 270. The top panel 290 has a length that is greater than the length L3 of the bridge piece 270. As such, as shown in FIG. 21, when the bridge piece 270 is received in the lower channel 130, the top panel 290 is positioned above the bottom wall 90 of the upper portion 64 and partially overlaps the bottom wall 90.

With reference to FIGS. 20 and 21, the bridge piece 270 further includes a plurality of holes 310. The illustrated holes 310 are defined by the bottom panel 286 and the top panel 290. In other embodiments, the top panel 290 may only include the holes 310. The holes 310 align with some of the holes 106 of the upper portion 64 and some of the elongated holes 160 of the lower portion 68. As such, some of the fasteners 230 may be received in the holes 310 of the bridge piece 270 when connecting a workspace accessory (e.g., such as the screen 80) to the chase 18 and the bridge piece 270.

To link the chase 18 coupled to the first table 10 and the second table 14 to a second chase 18 coupled to the third table 270 and the fourth table 278, the bridge piece 270 is supported by the lower channel 130 of each of the chases 18. In this position, the bridge piece 270 runs between the legs 26 of the tables 10, 14, 274, 278.

In one example, to couple more than two tables via the chases 18, the first chase 18 is coupled to the first table 10 and the second table 14, as described above. Thereafter, one end of the bridge piece 270 is slid into the lower channel 130 of the first chase 18. The second chase 18 is then positioned such that an opposite end of the bridge piece 270 is received in the lower channel 130 of the second chase 18. The second chase 18 is then coupled to the third and fourth tables 274, 278, as described above. Additional chases and tables may be used to further expand the system of tables.

In operation, a user may feed cables into the space between the first table 10 and the second table 14 and into the lower channel 130 of the lower portion 68 of the chase 18. The cables may be electrically connected to power outlets (e.g., the power outlets 271; FIG. 2) supported by the side walls 138 of the lower chase 18. Cords, wires, cables, and the like may be fed though a gap 314 (FIG. 15) defined between the second side edge 42 of the respective table 10, 14, 274, 278 and the workspace accessory 80 and/or the second side edge 42 of the opposite table 10, 14, 274, 278. The cords/wires/cables may then be fed through the cut-outs 102 in the upper channel 78 of the upper portion 64, and into the first and second trays 134*a*, 134*b* of the lower portion 68 for connection to the power outlets. In addition, cords, wires, cables, and the like may be fed though any of the openings (e.g., holes 164, 166) disposed along the length of the first and second trays 134*a*, 134*b*. To inhibit the cords/wires/cables from escaping the first and second trays 134*a*, 134*b*, the end caps 210 may be positioned on the lower channel ends 148, 152 of the lower portion 68. Additional embodiments may include additional holes, openings, or the like for feeding wires. Additional embodiments may also include power outlets disposed at any location of the chase 18.

Accordingly, the chase 18 includes multiple pieces (e.g., the upper portion, the lower portion, the end caps, etc.) such that a user may start with the upper portion 64 and build on the upper portion 64 over time. For example, the user may initially utilize solely the upper portion 64 to connect the tables 10, 14. Subsequently, the user may add the lower portion 68 to provide additional accessory storage. Thereafter, the user may add the end caps 210 to retain the cables in the trays of the lower portion 68. Other tables 274, 278 may be coupled to the tables 10, 14 by one or more bridge pieces 270 for expanding the number of tables within the system 5. Additional components not expressly detailed herein may be incorporated with the chase 18 such that the chase 18 provides additional features (e.g., wire storage, routing of wires, accessory storage, etc.). In other words, since the chase 18 includes pieces that are removably couplable, the chase 18 may provide a simplistic chase or, alternatively, may provide a complex chase having additional wire storage and accessory features.

Although the invention has been described in detail with reference to certain preferred embodiments, variations and modifications exist within the scope and spirit of one or more independent aspects of the invention as described. Various features and advantages of the invention are set forth in the following claims.

What is claimed is:

1. A furniture system comprising:

a first table including a first tabletop and one or more first legs supporting the first tabletop, the first tabletop including a first upper surface and a first lower surface opposite the first upper surface;

a second table including a second tabletop and one or more second legs supporting the second tabletop, the second tabletop including a second upper surface and a second lower surface opposite the second upper surface;

a chase coupled to the first lower surface and the second lower surface to physically connect the first table to the second table, the chase including a first channel extending therethrough and an aperture in communication with the first channel, the first channel configured to receive one or more cables; and a power outlet received in the aperture of the chase and configured to be electrically coupled to at least one of the one or more cables.

2. The furniture system of claim 1, wherein the chase includes a cable management tray positioned adjacent the first channel and extending outwardly from the first channel, and wherein the cable management tray is positioned below the first table.

3. The furniture system of claim 2, wherein the cable management tray is a first cable management tray, the chase further including a second cable management tray positioned adjacent the first channel and extending outwardly from the first channel, and wherein the second cable management tray is positioned below the second table.

4. The furniture system of claim 1, wherein the chase includes a first sidewall and a second sidewall spaced from the first sidewall, wherein the first sidewall and the second sidewall at least partially define the first channel, and wherein the aperture is defined in the first sidewall.

5. The furniture system of claim 1, further comprising an end cap removably coupled to an end of the chase, wherein the end cap covers one end of the first channel.

6. The furniture system of claim 1, wherein the chase includes an upper portion removably coupled to the first table and the second table, and a lower portion removably coupled to the upper portion, wherein the upper portion includes a first bracket and a second bracket for removably coupling the upper portion to the first table and the second table, respectively, and wherein the lower portion includes the first channel.

7. The furniture system of claim 6, wherein the chase further includes a cover removably coupled to the lower portion, wherein the cover is positioned to cover a bottom of the first channel.

8. The furniture system of claim 1, further comprising a workspace accessory positioned between an edge of the first table and an edge of the second table, wherein the chase includes a second channel spaced apart from the first channel, and wherein the second channel provides a location for removably coupling the workspace accessory to the chase.

9. The furniture system of claim 1, further comprising a bridge piece configured to extend between the chase and another chase for coupling the first table and the second table to a third table and a fourth table, wherein the bridge piece includes a center channel configured to connect the first channel of the first chase to a channel of the second chase.

10. A chase for physically connecting a first table to a second table, the chase comprising:

an upper portion removably couplable to the first table and the second table, the upper portion including a first bracket for coupling the upper portion to the first table, a second bracket for coupling the upper portion to the second table, and a wall disposed between the first bracket and the second bracket; and a lower portion removably couplable to the wall of the upper portion, the lower portion including a first channel extending therethrough, the first channel configured to receive one or more cables, wherein the lower portion is removable from the upper portion while the first bracket and the second bracket of the upper portion remain coupled to the first table and the second table.

11. The chase of claim 10, wherein the lower portion includes a cable management tray positioned adjacent the first channel and extending outwardly from the first channel, and wherein the cable management tray is configured to be positioned below the first table.

12. The chase of claim 10, wherein the lower portion includes a first sidewall and a second sidewall spaced from the first sidewall, wherein the first sidewall and the second sidewall at least partially define the first channel, and wherein the first sidewall defines an aperture configured to receive a power outlet.

13. The chase of claim 10, further comprising an end cap removably coupled to an end of the lower portion, wherein the end cap covers one end of the first channel.

14. The chase of claim 10, wherein one of the upper portion and the lower portion includes a plurality of projections extending therefrom, wherein the other of the upper portion and the lower portion includes a plurality of slots, and wherein each projection is removably receivable within one of the plurality of slots for removably coupling the upper portion and the lower portion together.

15. The chase of claim 10, further comprising a cover removably coupled to the lower portion, wherein the cover is positioned to cover a bottom of the first channel.

16. The chase of claim 10, wherein the upper portion includes a second channel spaced apart from the first channel, and wherein the second channel provides a location for removably coupling a workspace accessory to the chase.

17. The chase of claim 10, further comprising a bridge piece configured to extend between the chase and another chase for coupling the first table and the second table to a third table and a fourth table, wherein the bridge piece includes a center channel configured to connect the first channel of the first chase to a channel of the second chase.

18. A chase for connecting a first table to a second table, the chase comprising:

an upper portion removably couplable to the first table and the second table, the upper portion including a first bracket for coupling the upper portion to the first table and a second bracket for coupling the upper portion to the second table;

a lower portion removably couplable to the upper portion, the lower portion including a first channel extending therethrough, the first channel configured to receive one or more cables;

a cover removably coupled to the lower portion, the cover positioned to cover a bottom of the first channel;

a first cable management tray positioned adjacent the first channel and extending outwardly from the first channel, the first cable management tray configured to be positioned below the first table;

a second cable management tray positioned adjacent the first channel and extending outwardly from the first channel, the second cable management tray configured to be positioned below the second table; and a second channel spaced apart from the first channel, the second channel providing a location for removably coupling a workspace accessory to the chase.

19. The chase of claim 18, further comprising an end cap removably coupled to an end of the lower portion, wherein the end cap covers one end of the first channel.

20. The chase of claim 18, further comprising a first sidewall and a second sidewall spaced from the first sidewall, wherein the first sidewall and the second sidewall at least partially define the first channel, wherein the first sidewall defines a first aperture configured to receive a first power outlet, and wherein the second sidewall defines a second aperture configured to receive a second power outlet.

* * * * *